US009214725B2

(12) United States Patent
Ikehata

(10) Patent No.: US 9,214,725 B2
(45) Date of Patent: Dec. 15, 2015

(54) ANTENNA DEVICE

(75) Inventor: Kazuhiko Ikehata, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 363 days.

(21) Appl. No.: 13/812,572

(22) PCT Filed: Aug. 30, 2011

(86) PCT No.: PCT/JP2011/069563

§ 371 (c)(1),
(2), (4) Date: Jan. 28, 2013

(87) PCT Pub. No.: WO2012/029759

PCT Pub. Date: Mar. 8, 2012

(65) Prior Publication Data

US 2013/0127685 A1 May 23, 2013

(30) Foreign Application Priority Data

Aug. 30, 2010 (JP) ..... 2010-192827

(51) Int. Cl.
*H01Q 3/24* (2006.01)
*H01Q 1/24* (2006.01)
*H01Q 21/24* (2006.01)

(52) U.S. Cl.
CPC ..... *H01Q 3/247* (2013.01); *H01Q 1/243* (2013.01); *H01Q 21/24* (2013.01)

(58) Field of Classification Search
USPC ..... 343/700 MS, 702, 876
See application file for complete search history.

(56) References Cited

U.S. PATENT DOCUMENTS

| | | | | |
|---|---|---|---|---|
| 6,753,827 | B2 * | 6/2004 | Oshiyama et al. | 343/876 |
| 6,771,223 | B1 * | 8/2004 | Shoji et al. | 343/702 |
| 2005/0119035 | A1 | 6/2005 | Miyano et al. | |
| 2013/0241798 | A1 * | 9/2013 | LEE et al. | 343/876 |

FOREIGN PATENT DOCUMENTS

| | | | |
|---|---|---|---|
| JP | 2003-338783 | A | 11/2003 |
| JP | 2004-140815 | A | 5/2004 |
| JP | 2007-60182 | A | 3/2007 |
| WO | WO 02/39544 | A1 | 5/2002 |

* cited by examiner

*Primary Examiner* — Tan Ho
(74) *Attorney, Agent, or Firm* — Birch, Stewart & Kolasch & Birch, LLP

(57) ABSTRACT

Provided is an antenna device (1) including: an antenna element (120); a substrate (100) on which a ground conductor is provided; a first feeding portion (130); a second feeding portion (140); and a switching section (111, 131, 141). A direction in which high frequency electric current mainly flows in the ground conductor is different from while the first feeding portion (130) feeds the antenna element (120) to while the second feeding portion (140) feeds the antenna element (120).

9 Claims, 20 Drawing Sheets

ANTENNA DEVICE

TECHNICAL FIELD

The present invention relates to an antenna device including an antenna element. The present invention particularly relates to an antenna device with polarization diversity.

BACKGROUND ART

An antenna device capable of transmitting and receiving different polarized waves allows to select an appropriate polarization to transmit and receive, thereby making it possible to perform communication even in a case where polarization of a radio wave that the antenna device receives is changed or in a case where the antenna device changes its orientation, as in the case of mobile phones. Such a technique is known as polarization diversity.

Patent Literature 1 describes antenna devices that attain polarization diversity by use of one (1) antenna element. FIGS. 20 and 21 illustrate the antenna devices described in Patent Literature 1.

An antenna device 10 illustrated in FIG. 20 includes an antenna element 1020 having an X shape. In a case where the antenna element 1020 is fed by a feeding portion 1030, a high-frequency electric current flows in the antenna element 1020 in a direction indicated by an arrow 1031 (see (*a*) of FIG. 20). Meanwhile, in a case where the antenna element 1020 the antenna element 1020 the antenna element 1020 is fed by a feeding portion 1040, high frequency electric current flows in the antenna element 1020 in a direction indicated by an arrow 1041 (see (*b*) of FIG. 20).

An antenna device 11 illustrated in FIG. 21 includes an antenna element 1120 having an L shape. The antenna element 1120 has a center part 1150 which is grounded. In a case where the antenna element 1020*a* is fed by a feeding portion 1130, high frequency electric current flows in the antenna element 1020 in a direction indicated by an arrow 1131 (see (*a*) of FIG. 21). Meanwhile, in a case where the antenna element 1020 is fed by a feeding portion 1140, high frequency electric current flows in the antenna element 1020 in a direction indicated by an arrow 1041 (see (*b*) of FIG. 21).

Thus, the antenna devices described in Patent Literature 1 is configured to change the direction of the flow of the high frequency electric current in the antenna element by changing where the feeding portion is provided, so as to switch main polarization of the radio wave to be transmitted or received. Such antenna devices attain polarization diversity by use of one (1) antenna element, and therefore can advantageously reduce cost, space, and the like required for the antenna element.

CITATION LIST

Patent Literature

Patent Literature 1

Japanese Patent Application Publication, Tokukai No. 2003-338783 A (Publication Date: Nov. 28, 2003)

SUMMARY OF INVENTION

Technical Problem

However, the antenna element described in Patent Literature 1 should have an X shape, an L shape, or like shape so as to be able to flow high frequency electric currents for respective different polarized waves. This puts restrictions on the shape of the antenna element, thereby decreasing flexibility in design of the antenna device. Particularly, in a case where electronic parts and a ground are provided not to be overlapped with the antenna element for the sake of prevention of deterioration in the property of the antenna element, the flexibility in design of the antenna device is further decreased. This results in further problems such as difficulty in downsizing the antenna device.

The present invention was made in view of the problem, and a main object of the present invention is to provide a technique of increasing flexibility in design of an antenna device with polarization diversity.

Solution to Problem

In order to attain the main object, an antenna device of the present invention is configured to include: an antenna element; a substrate on which a ground conductor is provided; a first feeding portion and a second feeding portion, provided on the substrate, each for feeding the antenna element; and a switching section for switching which one of the first feeding portion and the second feeding portion feeds the antenna element, a direction in which high frequency electric current mainly flows in the ground conductor being different from while the first feeding portion feeds the antenna element to while the second feeding portion feeds the antenna element.

According to the configuration, any one of the first feeding portion and the second feeding portion feeds the antenna element. The switching section switches which one of the first feeding portion and the second feeding portion feeds the antenna element. The first feeding portion and the second feeding portion are provided on the substrate, and the ground conductor is provided on the substrate. Therefore, the feeding of the antenna element by the first feeding portion or the second feeding portion causes high frequency electric current to flow in the ground conductor. The antenna device of the present invention can suitably transmit and receive a radio wave polarized in direction along the direction in which the high frequency electric current mainly flows in the ground conductor. By switching over the switching section which one of the first feeding portion and the second feeding portion feeds the antenna element so as to control the direction in which high frequency electric current mainly flows in the ground conductor, it is possible to switch a direction of a main polarization of the radio wave to be transmitted or received. That is, the direction of the main polarization of the radio wave to be transmitted or received can be switched over by use of the switching section, by causing the direction in which high frequency electric current mainly flows in the ground conductor to differ between when the first feeding portion feeds the antenna element and when the second feeding portion feeds the antenna element. Thereby, polarization diversity is attained. This provides greater flexibility in design of a device in which polarization diversity is attained. This is because the shape of the antenna element is not limited to a specific shape.

Advantageous Effects of Invention

An antenna device of the present invention does not require a specially-shaped antenna element so as to be capable of switching the direction of main polarization of a radio wave to be transmitted or received. This makes it possible to increase flexibility in design of the device with polarization diversity.

DESCRIPTION OF EMBODIMENTS

Figure 1:
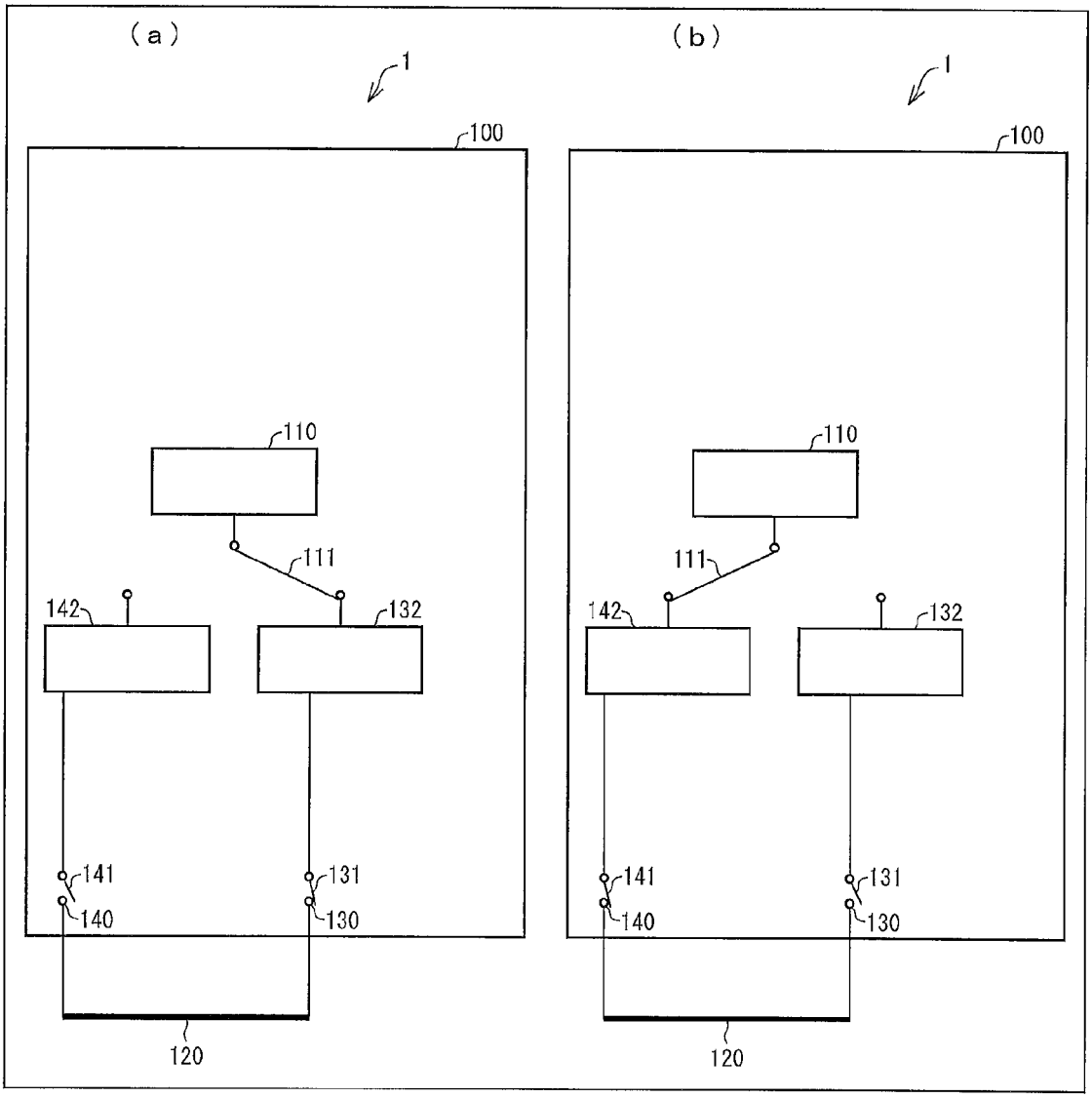
FIG. 1 is a view schematically illustrating a configuration of an antenna device in accordance with an embodiment (Embodiment 1) of the present invention. (*a*) of FIG. 1 illustrates a state where feeding portion feeds an antenna element. (*b*) of FIG. 1 illustrates a state where the other feeding portion feeds the antenna element.

The present invention provides an antenna device including: an antenna element; a substrate on which a ground conductor is provided; a first feeding portion and a second feeding portion, each being provided on the substrate and being configured to feed the antenna element; and a switching section for switching which one of the first feeding portion and the second feeding portion feeds the antenna element, a direction in which high frequency electric current mainly flows in the ground conductor being different between when the first feeding portion feeds the antenna element and when the second feeding portion feeds the antenna element.

The antenna device of the present invention is thus configured such that the direction in which high frequency electric current mainly flows in the ground conductor is different between when the first feeding portion feeds the antenna element and when the second feeding portion feeds the antenna element. It is therefore possible to switch, by use of the switching section, a main polarization direction of a radio wave to be transmitted or received. This makes it possible to attain polarization diversity without employing a special antenna shape.

The antenna device of the present invention is not limited to a specific one provided that it is configured such that the direction in which high frequency electric current mainly flows in the ground conductor is different between when the first feeding portion feeds the antenna element and when the second feeding portion feeds the antenna element. However, for example, the following antenna device in which the first feeding portion and the second feeding portion are provided can be suitably employed.

Where an antenna device is configured such that main polarization is in a first direction while the second feeding portion feeds the antenna element, and the main polarization is in a second direction orthogonal to the first direction while the first feeding portion feeds the antenna element, it is preferable that (1) the first feeding portion and the second feeding portion are positioned such that an electric length between the first feeding portion and a center of an electric length of a first path which crosses the ground conductor in the first direction through the first feeding portion is shorter than an electric length between the second feeding portion and a center of an electric length of a second path which crosses the ground conductor in the first direction through the second feeding portion, (2) the first feeding portion and the second feeding portion are positioned such that the sum of an electric length of the antenna element and a difference in electric length between a part of a third path which crosses the ground conductor in the second direction through the first feeding portion and the other part of the third path, the third path being divided into the part and the other part via the first feeding portion, is closer to a half wavelength of an applied frequency band of the antenna element than the sum of the electric length of the antenna element and a difference in electric length between a part of a fourth path which crosses the ground conductor in the second direction through the second feeding portion and the other part of the fourth path, the fourth path being divided into the part and the other part via the second feeding portion, and (3) the second feeding portion is provided such that the sum of the electric length of the antenna element and a difference in electric length between a part and the other part of the second path which is divided into the part and the other part via the second feeding portion, is closer to the half wavelength of the applied frequency band of the antenna element than the sum of the electric length of the antenna element and the difference in electric length between the part and the other part of the fourth path.

Note here that the first feeding portion is provided so as to be closer to the center of the electric length of the first path by providing the first feeding portion and the second feeding portion as described in (1). This causes electric currents having respective reverse phases to flow in the first direction from the first feeding portion toward respective end parts of the first path thereby canceling each other, while the first feeding portion feeds the antenna element. It is therefore possible to successfully have the main polarization in the second direction.

In contrast, the second feeding portion is provided far from the center of the electric length of the second path. This allows no or not much canceling between electric currents that flow in the second direction from the second feeding portion while the second feeding portion feeds the antenna element, unlike while the first feeding portion feeds the antenna element. This allows to successfully have the main polarization in the first direction while the second feeding portion feeds the antenna element.

When the first feeding portion feeds the antenna element, an effective electric length, in the second direction, of the ground conductor, in which effective electric length mutual cancellation of electric currents having respective reverse phases is taken into consideration, is the difference in electric length between the part and the other part of the third path. When the second feeding portion feeds the antenna element, an effective electric length, in the second direction, of the ground conductor, in which effective electric length mutual cancellation of electric currents having respective reverse phases is taken into consideration, is the difference in electric length between the part and the other part of the fourth path.

Therefore, by providing the first feeding portion and the second feeding portion as described in (2), the sum of the electric length of the antenna element and the effective electric length, in the second direction, of the ground conductor while the first feeding portion feeds the antenna element becomes closer to the half wavelength of the applied frequency band of the antenna element than the sum of the electric length of the antenna element and the effective electric length, in the second direction, of the ground conductor while the second feeding portion feeds the antenna element.

This causes higher electric current to flow in the second direction while the first feeding portion feeds the antenna element than while the second feeding portion feeds the antenna element. It is therefore possible to make polarization greater in the second direction while the first feeding portion feeds the antenna element than while the second feeding portion feeds the antenna element.

By providing the second feeding portion as described in (3), while the second feeding portion feeds the antenna element, the sum of the electric length of the antenna element and the effective electric length, in the first direction, of the ground conductor becomes closer to the half wavelength of the applied frequency band of the antenna element than the sum of the electric length of the antenna element and the effective electric length, in the second direction, of the ground conductor. This causes higher electric current to flow in the first direction than in the second direction, thereby successfully causing the main polarization in the first direction when the second feeding portion feeds the antenna element.

Thus, the configuration in which the first and second feeding portions are provided as described in (1) through (3) makes it possible to have the main polarization in the second direction while the first feeding portion feeds the antenna element, and to make the polarization greater in the second direction while the first feeding portion feeds the antenna element than while the second feeding portion feeds the antenna element. It is also possible to have the main polarization in the first direction while the second feeding portion feeds the antenna element. Hence, the direction of the main polarization can be switched as appropriate.

The following description will discuss various examples of the configuration of the present invention by describing Embodiments. As described in Embodiments 1 through 7 of the present invention, the first feeding portion may be provided at the center of an edge side of the substrate on which the ground (ground conductor) is provided, and the second feeding portion may be provided at an end part of the edge side of the substrate. Alternatively, the first feeding portion and the second feeding portion may be provided in other places as described in Embodiments 8 and 9. Further, a direction in which the first feeding portion is connected to the second feeding portion may be parallel to a polarization direction, as described in Embodiments 1 through 7, and 9. Alternatively, the direction may be different from the polarization direction as described in Embodiment 8.

(Embodiment 1)

Figure 2:
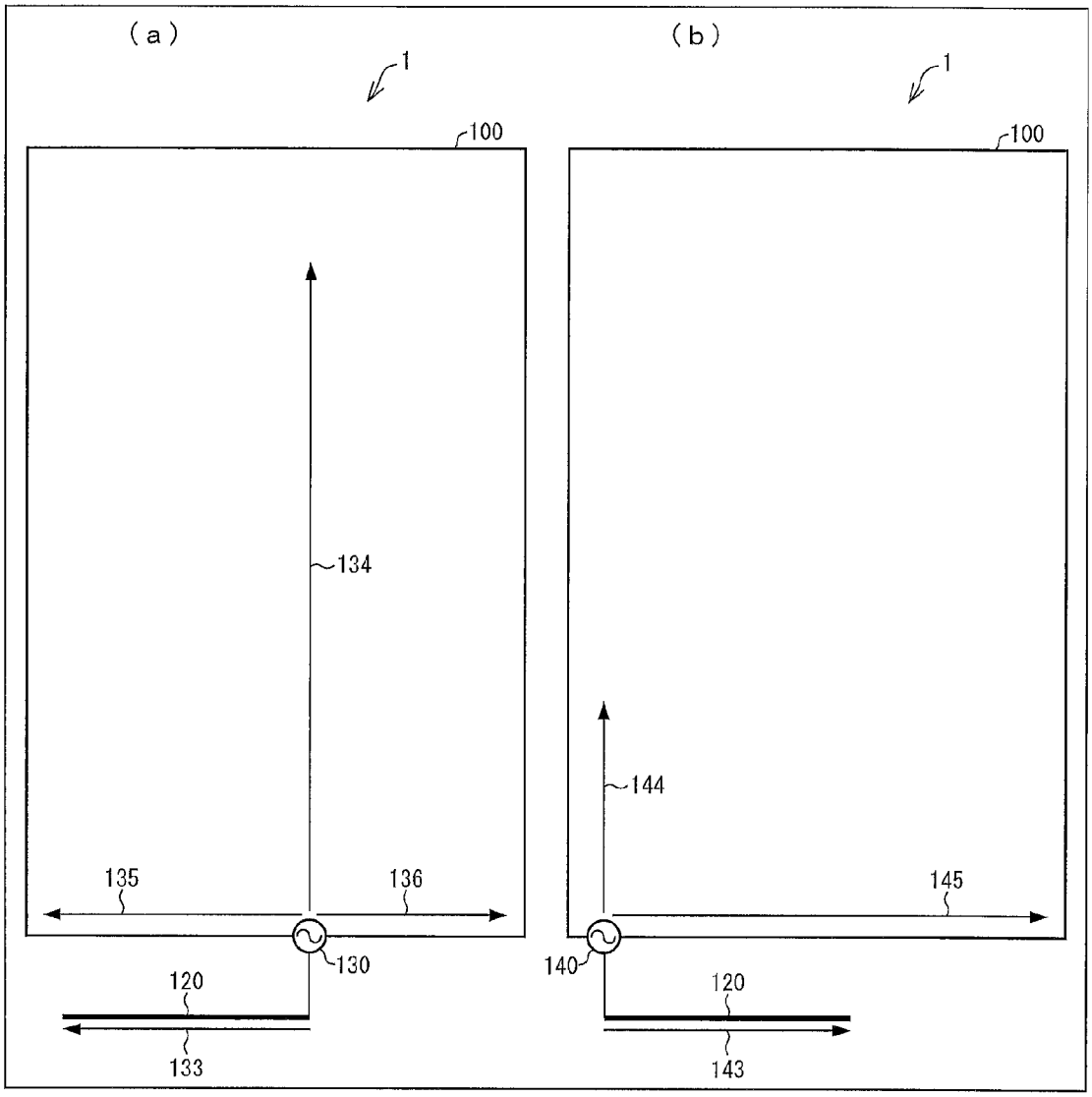
FIG. 2 is a view schematically illustrating high frequency electric current that flows in the antenna device in accordance with the embodiment (Embodiment 1) of the present invention. (*a*) of FIG. 2 illustrates a state where the feeding portion feeds the antenna element. (*b*) of FIG. 2 illustrates a state where the other feeding portion feeds the antenna element.

FIG. 1 is a view schematically illustrating a configuration of an antenna device 1 in accordance with an embodiment (Embodiment 1) of the present invention. FIG. 2 is a view schematically illustrating high frequency electric current that flows in the antenna device 1. Each (*a*) of FIGS. 1 and 2 illustrates a state where a feeding portion feeds an antenna element in the antenna device 1. Each (*b*) of FIGS. 1 and 2 illustrates a state where the other feeding portion feeds the antenna element.

The antenna device 1 includes a substrate 100 on which a ground (ground conductor) is provided, and an antenna element 120 (see FIG. 1). On the substrate 100 provided are a transmitting and receiving circuit 110, a first feeding portion 130, a first matching circuit 132, a second feeding portion 140, and a second matching circuit 142. The antenna element 120 has a linear shape. The first feeding portion 130 and the second feeding portion 140 are connected to respective end parts of the antenna element 120.

Note here that (i) a direction in which high frequency electric current flows in the ground conductor and (ii) where the first feeding portion 130 and the second feeding portion 140 are provided, are determined by determining a first direction and a second direction orthogonal to each other on the substrate 100. For example, in a case where a substantially rectangular substrate, such as the substrate 100 of Embodiment 1, is employed, a lateral direction and a longitudinal direction of the substantially rectangular substrate can be determined to be the first direction and the second direction, respectively. In this case, which one of the lateral direction and the longitudinal direction is determined to be the first direction can be determined according to the following condition.

That is, assume that (i) an electric length, in the first direction, of the ground conductor provided on the substrate 100 is a first electric length and (ii) an electric length, in the second direction, of the ground conductor provided on the substrate 100 is a second electric length. On the assumption, the first direction and the second direction are determined such that the sum of the first electric length and an electric length of the antenna element 120 is closer to a half wavelength of an applied frequency band of the antenna element 120 than the sum of the second electric length and the electric length of the antenna element 120.

The applied frequency band of the antenna element 120 is not particularly limited but may be determined as appropriate in accordance with application of the antenna device 1.

The first feeding portion 130 is located such that a dipole antenna, constituted by (i) the ground conductor provided on the substrate 100 and (ii) the antenna element 120, has main polarization in the second direction while the first feeding portion 130 feeds the antenna element 120. Specifically, the first feeding portion 130 is provided around a center part, in the first direction, of the substrate 100, and around an end part, in the second direction, of the substrate 100. In a case where the first feeding portion 130 feeds the antenna element 120 around the center part, in the first direction, of the substrate 100, reverse phase electric current flows in the first direction (later described). This weakens a property of the dipole antenna in the first direction. In contrast, in the case, reverse phase electric current that flows in the second direction is prevented. Thus, the dipole antenna has the main polarization in the second direction.

Meanwhile, the second feeding portion 140 is located such that the dipole antenna has the main polarization in the first direction while the second feeding portion 140 feeds the antenna element 120. Specifically, the second feeding portion 140 can be provided around an end part, in the first and second directions, of the substrate 100. As early described, the sum of the first electric length and the electric length of the antenna element 120 is closer to the half wavelength of the applied frequency band of the antenna element 120 than the sum of the second electric length and the electric length of the antenna element 120. Therefore, higher electric current flows through the ground conductor in the first direction than in the second direction (power becomes greater in the first direction than in the second direction). Thus, the dipole antenna has the main polarization in the first direction.

The first feeding portion 130 can thus be provided in the center part, in the first direction, of the substrate 100, and in the end part, in the second direction, of the substrate 100. What is meant by "the center part, in the first direction, of the substrate 100, and the end part, in the second direction, of the substrate 100" in the specification is a location (i) around a center, in the first direction, of the substrate 100, and around an end, in the second direction, of the substrate 100, and (ii) where the dipole antenna has the main polarization in the second direction. For example, a distance between the end, in the first direction, of the substrate 100 and the location is preferably not less than 40% but not more than 60%, and particularly preferably not less than 45% but not more than 55%, of the whole electric length in the first direction. Further, a distance between the end, in the second direction, of the substrate 100 and the location is preferably not less than 0% but not more than 10%, and particularly preferably not less than 0% but not more than 5%, of the whole electric length in the second direction.

Further, the second feeding portion 140 can thus be provided in the end part, in the first and second direction, of the substrate 100. What is meant by "the end part, in the first and second direction, of the substrate 100" in the specification is a location (i) around the end, in the first and second direction, of the substrate 100, and (ii) where the dipole antenna has the main polarization in the first direction. For example, a distance between the end, in the first direction, of the substrate 100 and the location is preferably not less than 0% but not more than 10%, and particularly preferably not less than 0% but not more than 5%, of the whole electric length in the first direction. Further, a distance between the end, in the second direction, of the substrate 100 and the location is preferably not less than 0% but not more than 10%, and particularly preferably not less than 0% but not more than 5%, of the whole electric length in the second direction.

Note that the substrate 100 may be provided with a substrate on which no ground conductor is provided, or may be integrated with the substrate. In other words, in a case where a ground conductor is provided only in a region of the substrate of the antenna device 1, what is meant by the "substrate on which a ground conductor is provided", that is, the substrate 100 is the region where the ground conductor is provided. For example, in a case where the ground conductor is provided only in a half region (in which the second feeding portion 140 is provided), in the first direction, of the substrate 100 (see FIG. 1), a center part in the first direction represents a center part of the half region where the ground conductor is provided. In the case, the first feeding portion 130 should be provided closer to the second feeding portion 140 than where the first feeding portion 130 is provided in FIG. 1.

The transmitting and receiving circuit 110 carries out signal processes (analog-digital conversion, digital-analog conversion, modulation or demodulation, multiplexing or separation, control of a switching section (later described), etc.) for transmission and reception of radio waves. The transmitting and receiving circuit 110 causes the first feeding portion 130 or the second feeding portion 140 to feed the antenna element 120.

The transmitting and receiving circuit 110 is connected to the first matching circuit 132 and the second matching circuit 142 via a first switching section (switching section) 111. The first switching section 111 can switch between (i) connection of the first matching circuit 132 to the transmitting and receiving circuit 110 and (ii) connection of the second matching circuit 142 to the transmitting and receiving circuit 110. That is, the first switching section 111 connects the transmitting and receiving circuit 110 to the first matching circuit 132 in a case where the first feeding portion 130 feeds the antenna element 120, and in contrast, the first switching section 111 connects the transmitting and receiving circuit 110 to the second matching circuit 142 in a case where the second feeding portion 140 feeds the antenna element 120.

The first feeding portion 130 is connected to the first matching circuit 132 via a second switching section (switching section, first switching element) 131. The second switching section 131 connects the first matching circuit 132 to the first feeding portion 130 in the case where the first feeding portion 130 feeds the antenna element 120. In contrast, the second switching section 131 disconnects the first matching circuit 132 from the first feeding portion 130 otherwise. The second feeding portion 140 is connected to the second matching circuit 142 via a third switching section (switching section, second switching element) 141. The third switching section 141 connects the second matching circuit 142 to the second feeding portion 140 in the case where the second feeding portion 140 feeds the antenna element 120. In contrast, the third switching section 141 disconnects the second matching circuit 142 from the second feeding portion 140 otherwise.

Thus, in the antenna device 1, the first through third switching sections can switch which one of the first feeding portion 130 and the second feeding portion 140 feeds the antenna element 120. For example, the transmitting and receiving circuit 110 may control the first through third switching sections to switch.

(*a*) of FIG. 1 illustrates a configuration in which the first feeding portion 130 feeds the antenna element 120. As illustrated in (*a*) of FIG. 1, (i) the first switching section 111 connects the transmitting and receiving circuit 110 to the first matching circuit 132, (ii) the second switching section 131 connects the first matching circuit 132 to the first feeding portion 130, and (iii) the third switching section 141 disconnects the second matching circuit 142 from the second feeding portion 140.

(*a*) of FIG. 2 illustrates a direction in which high frequency electric current flows while the first feeding portion 130 feeds the antenna element 120. As illustrated in (*a*) of FIG. 2, while the first feeding portion 130 feeds the antenna element 120, high frequency electric current 133 flows in the antenna element 120, and high frequency electric current, which is excited by the first feeding portion 130, flows in the ground conductor provided on the substrate 100.

As early described, the first feeding portion 130 is located in the end part, in the second direction, of the substrate 100. This causes high frequency electric current 134 to flow toward the other end part, in the second direction, of the substrate 100. As also early described, the first feeding portion 130 is located in the center part, in the first direction, of the substrate 100. This causes high frequency electric current 135 and high frequency electric current 136 to flow toward respective end parts, in the first direction, of the substrate 100.

Note here that the high frequency electric current 135 and the high frequency electric current 136 are reverse phased to each other, thereby canceling each other to be remarkably weakened. Therefore, high frequency electric current flows mainly in the second direction while the first feeding portion 130 feeds the antenna element 120.

Note that what is meant by the "high frequency electric current flows in the ground conductor" is electric current excited by the first feeding portion 130 or the second feeding portion 140. The electric current has a frequency that basically equals to that of the applied frequency band of the antenna element 120.

In the specification, in which mutual cancellation of electric currents having respective reverse phases is taken into consideration, the direction in which high frequency electric current mainly flows means a direction in which highest electric current flows. The direction in which high frequency electric current mainly flows in the ground conductor corresponds to a direction of main polarization of a radio wave which can be suitably transmitted or received by the antenna device.

(*b*) of FIG. 1 illustrates a configuration in which the second feeding portion 140 feeds the antenna element 120. As illustrated in (*b*) of FIG. 1, (i) the first switching section 111 connects the transmitting and receiving circuit 110 to the second matching circuit 142, (ii) the third switching section 141 connects the second matching circuit 142 to the second feeding portion 140, and (iii) the second switching section 131 disconnects the first matching circuit 132 from the first feeding portion 130.

(*b*) of FIG. 2 illustrates a direction in which high frequency electric current flows while the second feeding portion 140 feeds the antenna element 120. As illustrated in (*b*) of FIG. 2, while the second feeding portion 140 feeds the antenna element 120, high frequency electric current 143 flows in the antenna element 120, and high frequency electric current, which is excited by the second feeding portion 140, flows in the ground conductor provided on the substrate 100.

As early described, the second feeding portion 140 is located in the end part, in the second direction, of the substrate 100. This causes high frequency electric current 144 to flow toward the other end part, in the second direction, of the substrate 100. As also early described, the second feeding portion 140 is located in the end part, in the first direction, of the substrate 100. This causes high frequency electric current 145 to flow toward the other end part, in the first direction, of the substrate 100.

Note here that, as early described, (i) the sum of the first electric length and the electric length of the antenna element 120 is closer to the half wavelength of the applied frequency band of the antenna element 120 than the sum of the second electric length and the electric length of the antenna element 120, and (ii) the antenna element 120 and the ground conductor constitutes the dipole antenna. This causes higher electric current to flow in a direction of an electric length which is closer to the half wavelength of the applied frequency band of the antenna element 120. It follows that the high frequency electric current 145 becomes greater than the high frequency electric current 144. That is, high frequency electric current flows mainly in the first direction while the second feeding portion 140 feeds the antenna element 120.

Thus, the direction in which high frequency electric current mainly flows in the ground conductor is different from while the first feeding portion 130 feeds the antenna element 120 to while the second feeding portion 140 feeds the antenna element 120. That is, it is possible to switch the direction in which high frequency electric current mainly flows in the ground conductor, and to switch the direction of a main polarization of a radio wave to be transmitted or received, by switching which one of the first feeding portion 130 and the second feeding portion 140 feeds the antenna element 120. As such, the antenna device 1 of Embodiment 1 can attain polarization diversity as appropriate.

Figure 19:
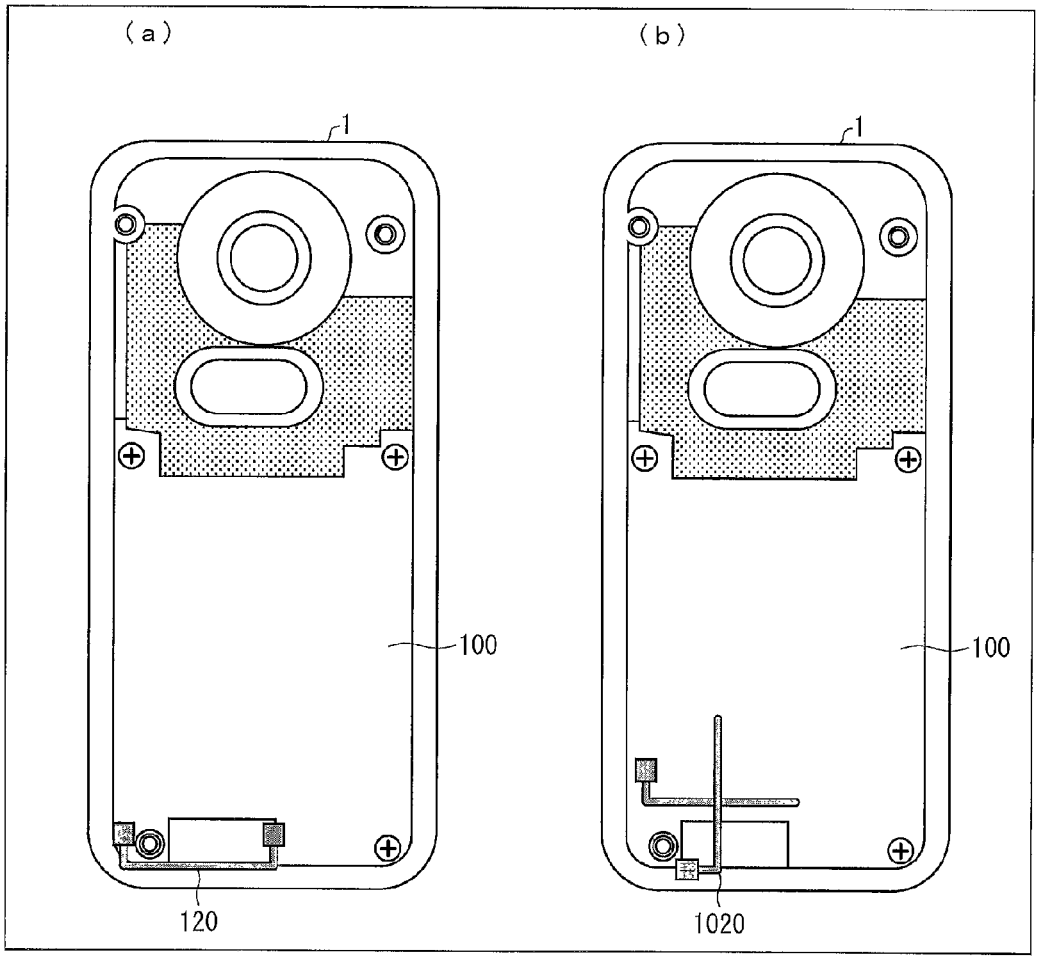
FIG. 19 is a comparative diagram in which an antenna element in accordance with an embodiment of the present invention is compared with a conventional antenna element. (*a*) of FIG. 19 illustrates the antenna element in accordance with an embodiment of the present invention. (*b*) of FIG. 19 illustrates the conventional antenna element.
Figure 20:
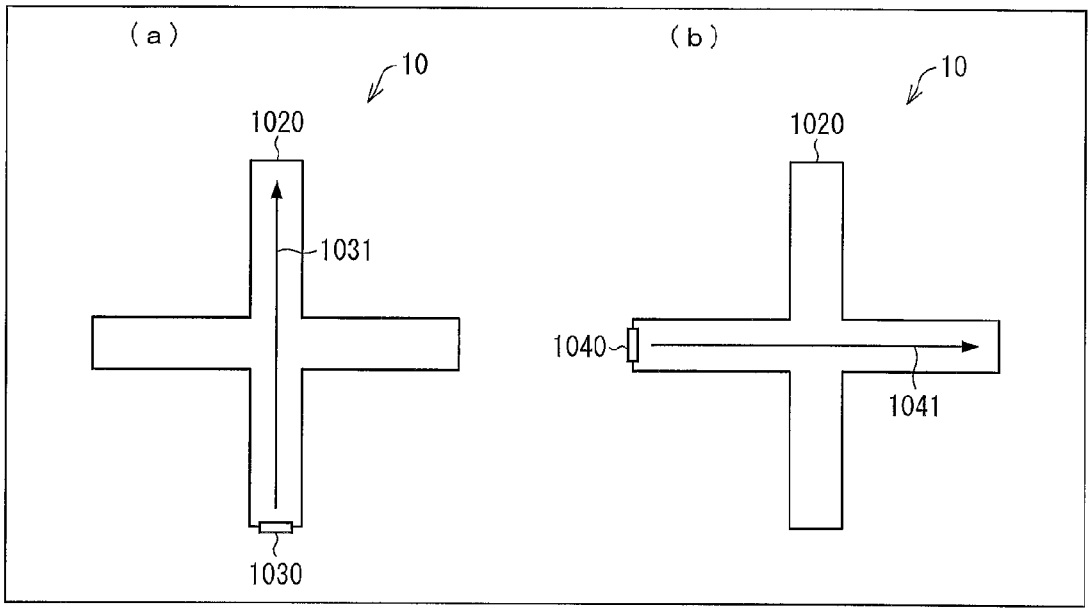
FIG. 20 is a view schematically illustrating an antenna device including a conventional X-shaped antenna element. (*a*) of FIG. 20 illustrates a state where a feeding portion feeds the conventional X-shaped antenna element. (*b*) of FIG. 20 illustrates a state where the other feeding portion feeds the conventional X-shaped antenna element.
Figure 21:
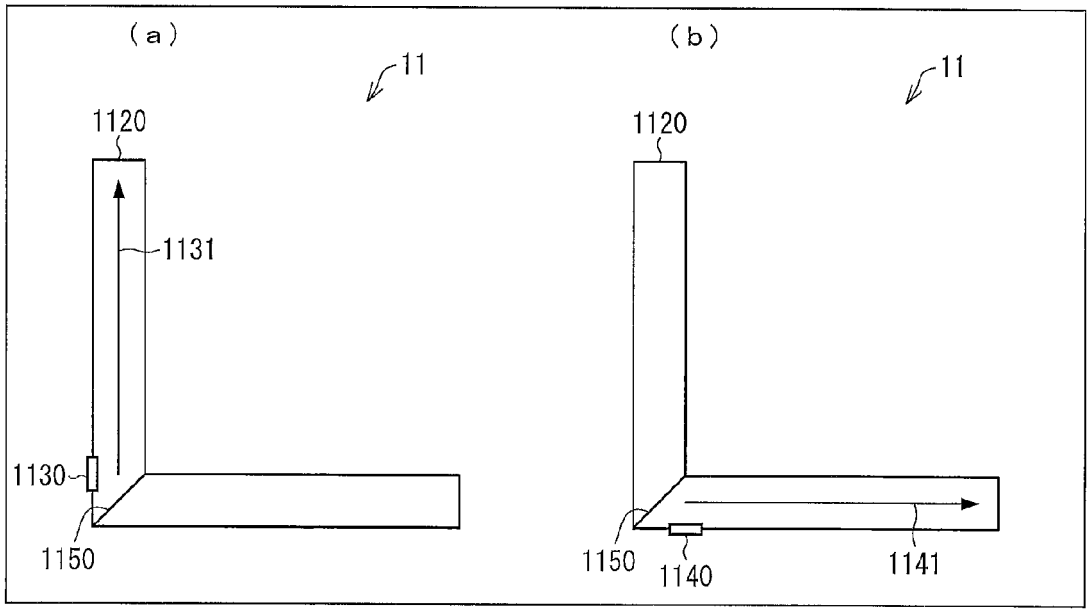
FIG. 21 is a view schematically illustrating an antenna device including a conventional L-shaped antenna element. (*a*) of FIG. 21 illustrates a state where a feeding portion feeds the conventional L-shaped antenna element. (*b*) of FIG. 21 illustrates a state where the other feeding portion feeds the conventional L-shaped antenna element.

The antenna element 120 of the antenna device 1 of Embodiment 1 has a linear shape. FIG. 19 is a comparative view in which (i) a case where the antenna device 1 of Embodiment 1 is applied to a mobile phone terminal (see (*a*) of FIG. 19) is compared with (ii) a case where an antenna element 1020 described in Patent Literature 1, instead of the antenna element 120, is applied to a mobile phone terminal (see (*b*) of FIG. 19). As is clear from FIG. 19, as compared with the antenna element 1020 described in Patent Literature 1, the antenna element 120 of Embodiment 1 (i) occupies smaller surface area, volume, etc. in the antenna device 1, (ii) further improves flexibility in design of the antenna device 1, and (iii) further easily attains downsizing of the antenna device 1.

Of course, the antenna element of the antenna device of the present invention is not limited to the linear antenna element but may be any antenna elements. The antenna device of the present invention may include the antenna element described in Patent Literature 1. That is, the shape of the antenna element of the antenna device of the present invention is not limited to a specific one, provided that the antenna device of the present invention is configured to control, by switching the feeding portions, the direction in which high frequency electric current mainly flows in the ground conductor provided on the substrate.

Note that where the antenna element 120 is provided is not limited to a specific one provided that the antenna element 120 is provided so as to be fed by the first feeding portion 130 and the second feeding portion 140. It is, however, preferable that no ground conductor be provided below the antenna element 120. Therefore, the antenna element 120 may be provided outside the substrate 100, as illustrated in FIG. 1. Alternatively, in a case where the antenna element 120 is provided on the substrate 100 (see (*a*) of FIG. 19), no ground conductor may be provided below the antenna element 120 provided on the substrate 100.

Note also that the antenna device of the present invention is not limited to a specific one provided that the antenna device of the present invention includes an antenna. The antenna device of the present invention is applicable to radio communication devices such as (i) mobile phone terminals, (ii) mobile radio terminals (for example, PDAs), and (iii) non-mobile radio communication devices. Further, the antenna device of the present invention, of course, can include members other than the above-described members in accordance with application of the antenna device of the present invention. The antenna device of the present invention can appropriately include (i) a circuit or a CPU for, for example, executing a communication application, (ii) an audio input section for receiving audio (transmitter), (iii) a speaker for outputting audio (receiver), (iv) an input section, such as a button or a touch panel, through which a user enters, (v) a display section, such as a liquid crystal display, for carrying out display, (vi) a housing, and (vii) a battery.

(Embodiment 2)

Figure 3:
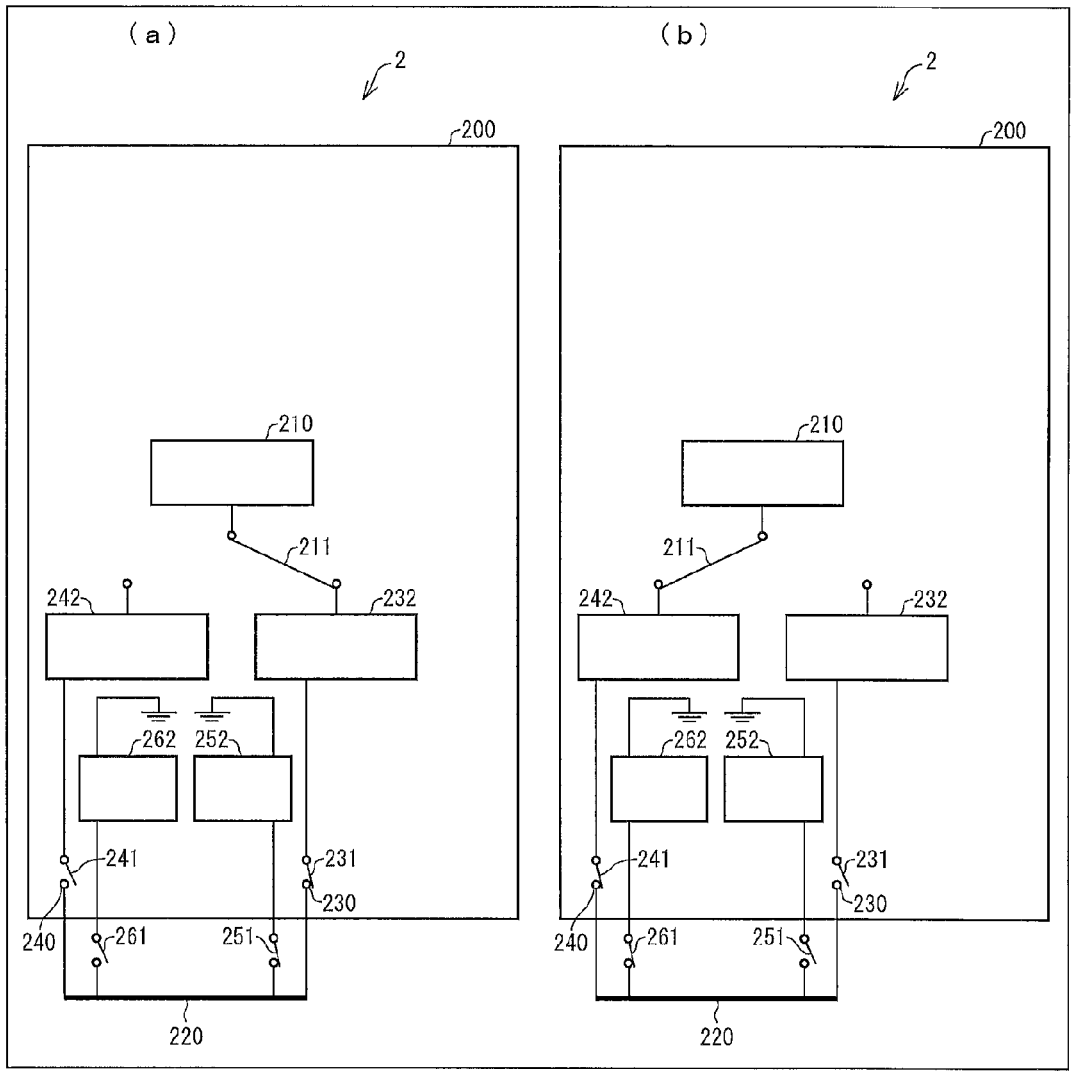
FIG. 3 is a view schematically illustrating a configuration of an antenna device in accordance with an embodiment (Embodiment 2) of the present invention. (*a*) of FIG. 3 illustrates a state where a feeding portion feeds an antenna element. (*b*) of FIG. 3 illustrates a state where the other feeding portion feeds the antenna element.
Figure 4:
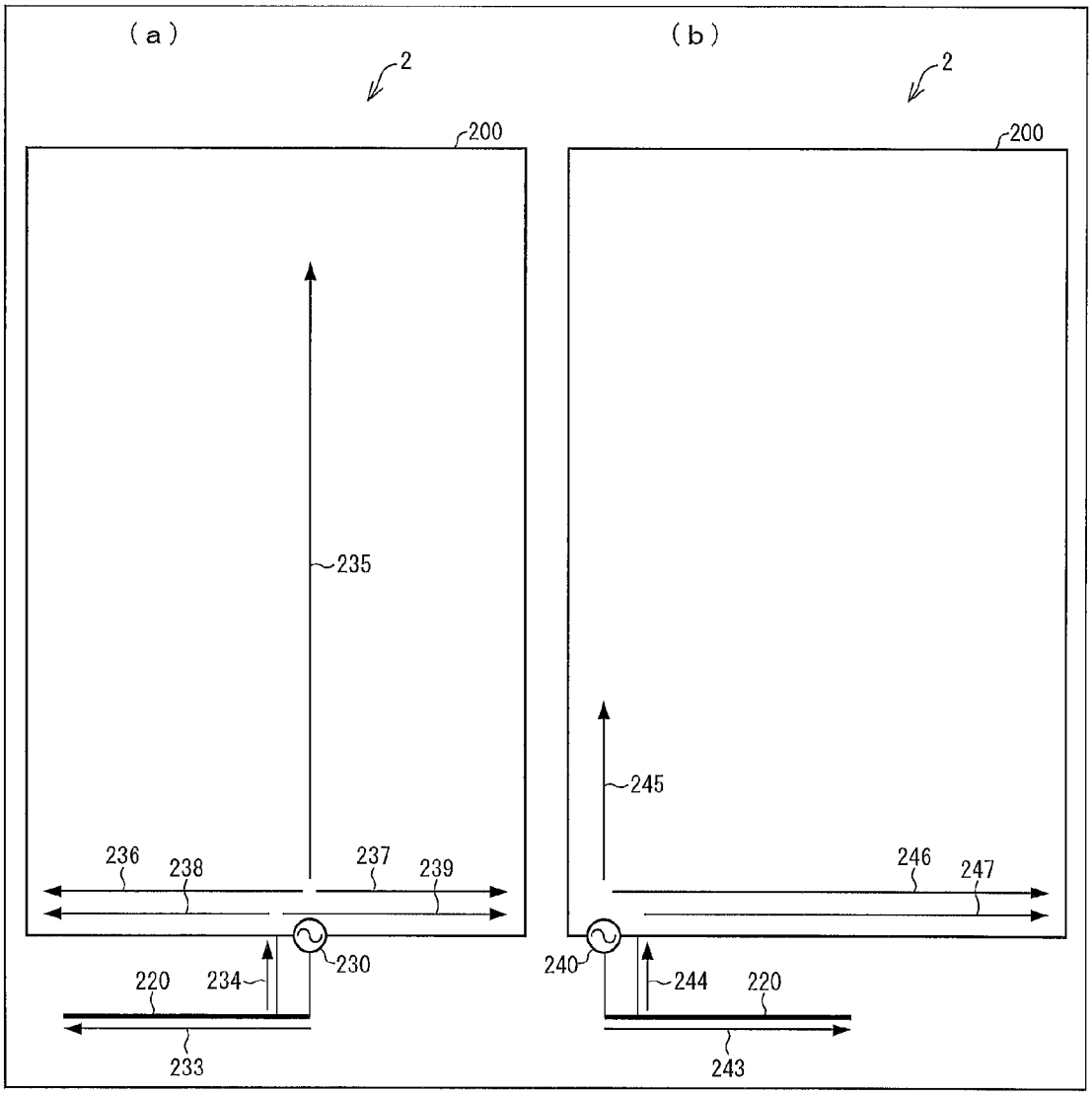
FIG. 4 is a view schematically illustrating high frequency electric current that flows in the antenna device in accordance with the embodiment (Embodiment 2) of the present invention. (*a*) of FIG. 4 illustrates a state where the feeding portion feeds an antenna element. (*b*) of FIG. 4 illustrates a state where the other feeding portion feeds the antenna element.

FIG. 3 is a view schematically illustrating a configuration of an antenna device 2 in accordance with an embodiment (Embodiment 2) of the present invention. FIG. 4 is a view schematically illustrating high frequency electric current that flows in the antenna device 2. Each (*a*) of FIGS. 3 and 4 illustrates a state where a feeding portion feeds an antenna element. Each (*b*) of FIGS. 3 and 4 illustrates a state where the other feeding portion feeds the antenna element.

The antenna device 2 includes a substrate 200 and an antenna element 220 (see FIG. 3), like the antenna device 1 of Embodiment 1. On the substrate 200 provided are a transmitting and receiving circuit 210, a first switching section (switching section) 211, a first feeding portion 230, a second switching section (switching section, first switching element) 231, a first matching circuit 232, a second feeding portion 240, a third switching section (switching section, second switching element) 241, and a second matching circuit 242.

Unlike the antenna device 1 of Embodiment 1, however, the antenna device 2 further includes a third matching circuit (antenna/ground conductor matching circuit) 252, a fourth switching section (antenna/ground conductor switching section) 251, a fourth matching circuit (antenna/ground conductor matching circuit) 262, and a fifth switching section (antenna/ground conductor switching section) 261. The following description will discuss in detail what is different from Embodiment 1, and description of what is identical to Embodiment 1 is omitted in Embodiment 2.

The fourth switching section 251 connects the antenna element 220 to the third matching circuit 252, and switches between electrical connection of the third matching circuit 252 to the antenna element 220 and electrical disconnection of the third matching circuit 252 to the antenna element 220. The third matching circuit 252 is a matching circuit for matching impedance of the antenna element 220. The third matching circuit 252 has a first terminal connected to the antenna element 220 via the fourth switching section 251, and a second terminal connected to a ground conductor.

The fifth switching section 261 connects the antenna element 220 to the fourth matching circuit 262, and switches between electrical connection of the fourth matching circuit 262 to the antenna element 220 and electrical disconnection of the fourth matching circuit 262 to the antenna element 220. The fourth matching circuit 262 is a matching circuit for matching impedance of the antenna element 220. The fourth matching circuit 262 has a first terminal connected to the antenna element 220 via the fifth switching section 261, and a second terminal connected to the ground conductor.

The first feeding portion 230 and the second feeding portion 240 are connected to respective end parts of the antenna element 220. The fourth switching section 251 and the fifth switching section 261 are connected to respective parts of the antenna element 220, which parts are inside the end parts of the antenna element 220.

(*a*) of FIG. 3 illustrates a configuration in which the first feeding portion 230 feeds the antenna element 220. As illustrated in (*a*) of FIG. 3, (i) the first switching section 211 connects the transmitting and receiving circuit 210 to the first matching circuit 232, (ii) the second switching section 231 connects the first matching circuit 232 to the first feeding portion 230, (iii) the third switching section 241 disconnects the second matching circuit 242 from the second feeding portion 240, (iv) the fourth switching section 251 connects the third matching circuit 252 to the antenna element 220, and (v) the fifth switching section 261 disconnects the fourth matching circuit 262 from the antenna element 220.

(*a*) of FIG. 4 illustrates a direction in which high frequency electric current flows while the first feeding portion 230 feeds the antenna element 220. While the first feeding portion 230 feeds the antenna element 220, high frequency electric current 233 flows in the antenna element 220 (see (*a*) of FIG. 4). While the high frequency electric current 233 flows in the antenna element 220, high frequency electric current 234 flows, via the fourth switching section 251 and the third matching circuit 252, in the ground conductor provided on the substrate 200. The antenna element 220 operates as an inverted F antenna while the first feeding portion 230 feeds the antenna element 220.

Further, high frequency electric current excited by the first feeding portion 230 flows in the ground conductor provided on the substrate 200. The first feeding portion 230 is located in an end part, in a second direction, of the substrate 200. This causes high frequency electric current 235 to flow toward the other end part, in the second direction, of the substrate 200. The first feeding portion 230 is also located in a center part, in a first direction, of the substrate 200. This causes high frequency electric current 236 and high frequency electric current 237 to flow toward respective end parts, in the first direction, of the substrate 200. Further, high frequency electric current that has flown from the antenna element 220 via the fourth switching section 251 to the substrate 200 becomes high frequency electric current 238 and high frequency electric current 239 that flow toward the respective end parts, in the first direction, of the substrate 200.

Note here that the high frequency electric current 236 and the high frequency electric current 237 are reverse phased to each other, and the high frequency electric current 238 and the high frequency electric current 239 are reverse phased to each other. Therefore, they cancel each other to be remarkably weakened. It follows that high frequency electric current flows mainly in the second direction while the first feeding portion 230 feeds the antenna element 220.

(*b*) of FIG. 3 illustrates a configuration in which the second feeding portion 240 feeds the antenna element 220. As illustrated in (*b*) of FIG. 3, (i) the first switching section 211 connects the transmitting and receiving circuit 210 to the second matching circuit 242, (ii) the second switching section 231 disconnects the first matching circuit 232 from the first feeding portion 230, (iii) the third switching section 241 connects the second matching circuit 242 to the second feeding portion 240, (iv) the fourth switching section 251 disconnects the third matching circuit 252 from the antenna element 220, and (v) the fifth switching section 261 connects the fourth matching circuit 262 to the antenna element 220.

(*b*) of FIG. 4 illustrates a direction in which high frequency electric current flows while the second feeding portion 240 feeds the antenna element 220. While the second feeding portion 240 feeds the antenna element 220, high frequency electric current 243 flows in the antenna element 220 (see (*b*) of FIG. 4). While the high frequency electric current 243 flows in the antenna element 220, high frequency electric current 244 flows, via the fifth switching section 261 and the fourth matching circuit 262, in the ground conductor provided on the substrate 200. The antenna element 220 also operates as the inverted F antenna while the second feeding portion 240 feeds the antenna element 220.

The second feeding portion 240 is located in the end part, in the second direction, of the substrate 200. This causes high frequency electric current 245 to flow toward the other end part, in the second direction, of the substrate 200. The second feeding portion 240 is also located in an end part, in the first direction, of the substrate 200. This causes high frequency electric current 246 to flow toward the other end part, in the first direction, of the substrate 220. Further, high frequency electric current that has flown from the antenna element 220 via the fifth switching section 261 to the substrate 200 becomes high frequency electric current 247 that flows toward the other end part, in the first direction, of the substrate 200.

Note here that the sum of an electric length of the antenna element 220 and the first electric length is closer to a half wavelength of an applied frequency band of the antenna element 220 than the sum of the electric length of the antenna element 220 and the second electric length. This causes the high frequency electric current 246 to be higher than the high frequency electric current 245. Further, the high frequency electric current 247 flows in the first direction. This causes high frequency electric current to flow mainly in the first direction while the second feeding portion 240 feeds the antenna element 220.

Thus, the direction in which high frequency electric current mainly flows in the ground conductor is different from while the first feeding portion 230 feeds the antenna element 220 to while the second feeding portion 240 feeds the antenna element 220. That is, it is possible to switch the direction in which high frequency electric current mainly flows, and to switch the direction of main polarization of a radio wave to be transmitted or received, by switching which one of the first feeding portion 230 and the second feeding portion 240 feeds the antenna element 220. The antenna element 220 can be configured to operate as the inverted F antenna. It is therefore possible to improve an antenna property. For example, it is possible to prevent deterioration in the antenna property of the antenna device 2 whose housing is being held by hand.

(Embodiment 3)

Figure 5:
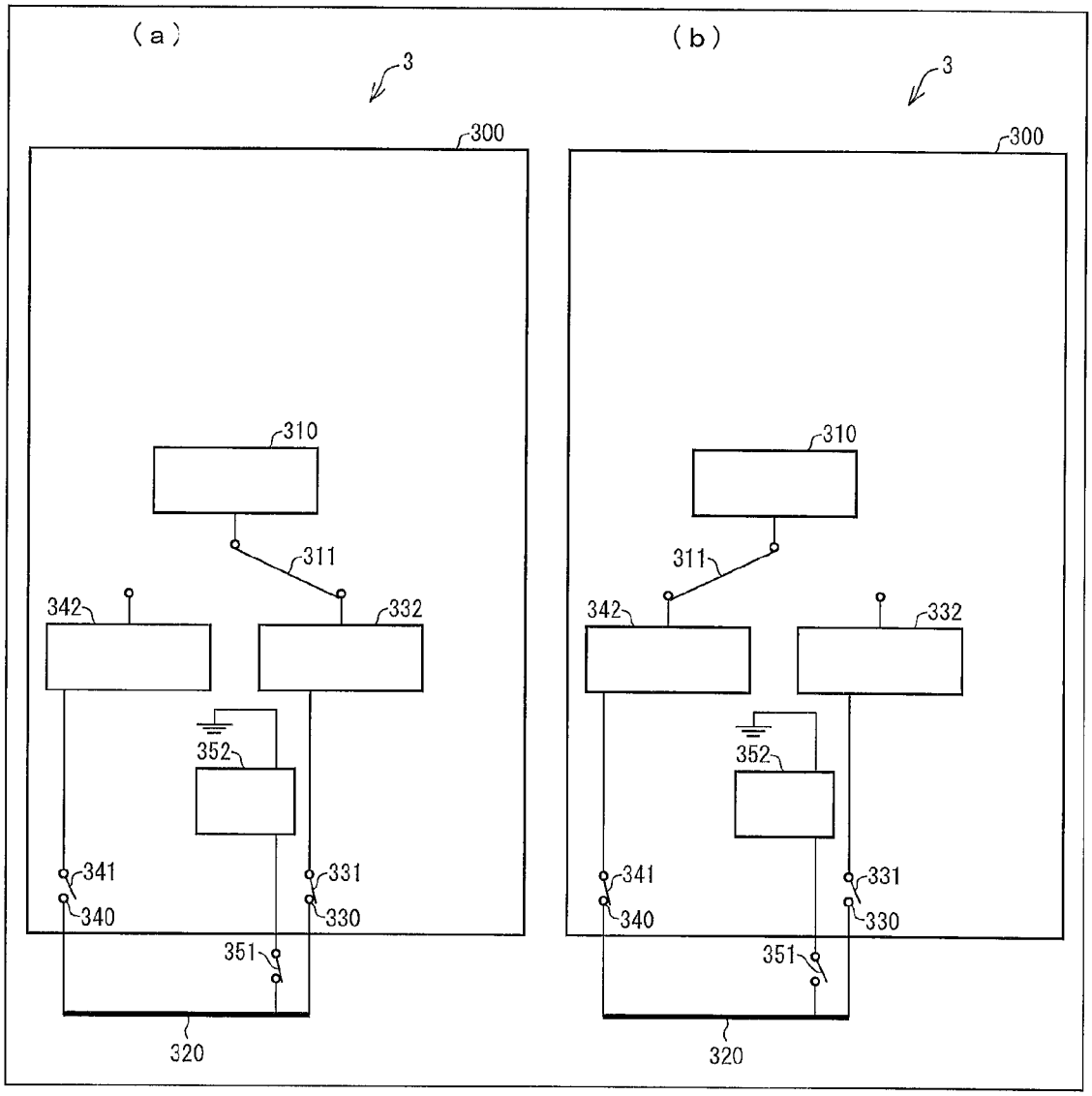
FIG. 5 is a view schematically illustrating a configuration of an antenna device in accordance with an embodiment (Embodiment 3) of the present invention. (*a*) of FIG. 5 illustrates a state where a feeding portion feeds an antenna element. (*b*) of FIG. 5 illustrates a state where the other feeding portion feeds the antenna element.

FIG. 5 is a view schematically illustrating a configuration of an antenna device 3 in accordance with an embodiment (Embodiment 3) of the present invention. (*a*) of FIG. 5 illustrates a state where a feeding portion feeds an antenna element. (*b*) of FIG. 5 illustrates a state where the other feeding portion feeds the antenna element.

The antenna device 3 includes a substrate 300 and an antenna element 320 (see FIG. 5), like the antenna device 2 of Embodiment 2. On the substrate 300 provided are a transmitting and receiving circuit 310, a first switching section (switching section) 311, a first feeding portion 330, a second switching section (switching section, first switching element) 331, a first matching circuit 332, a second feeding portion 340, a third switching section (switching section, second switching element) 341, a second matching circuit 342, a fourth switching section (antenna/ground conductor switching section) 351, and a third matching circuit (antenna/ground conductor matching circuit) 352. Note, however, that the antenna device 3 does not include a fifth switching section and a fourth matching circuit, unlike the antenna device 2 of Embodiment 2.

The antenna element 220 of the antenna device 3 operates as an inverted F antenna only while the first feeding portion 330 feeds the antenna element 320. The antenna device 3 may thus be configured such that the antenna element operates as the inverted F antenna only while any one of the feeding portions feeds the antenna element.

(Embodiment 4)

Figure 6:
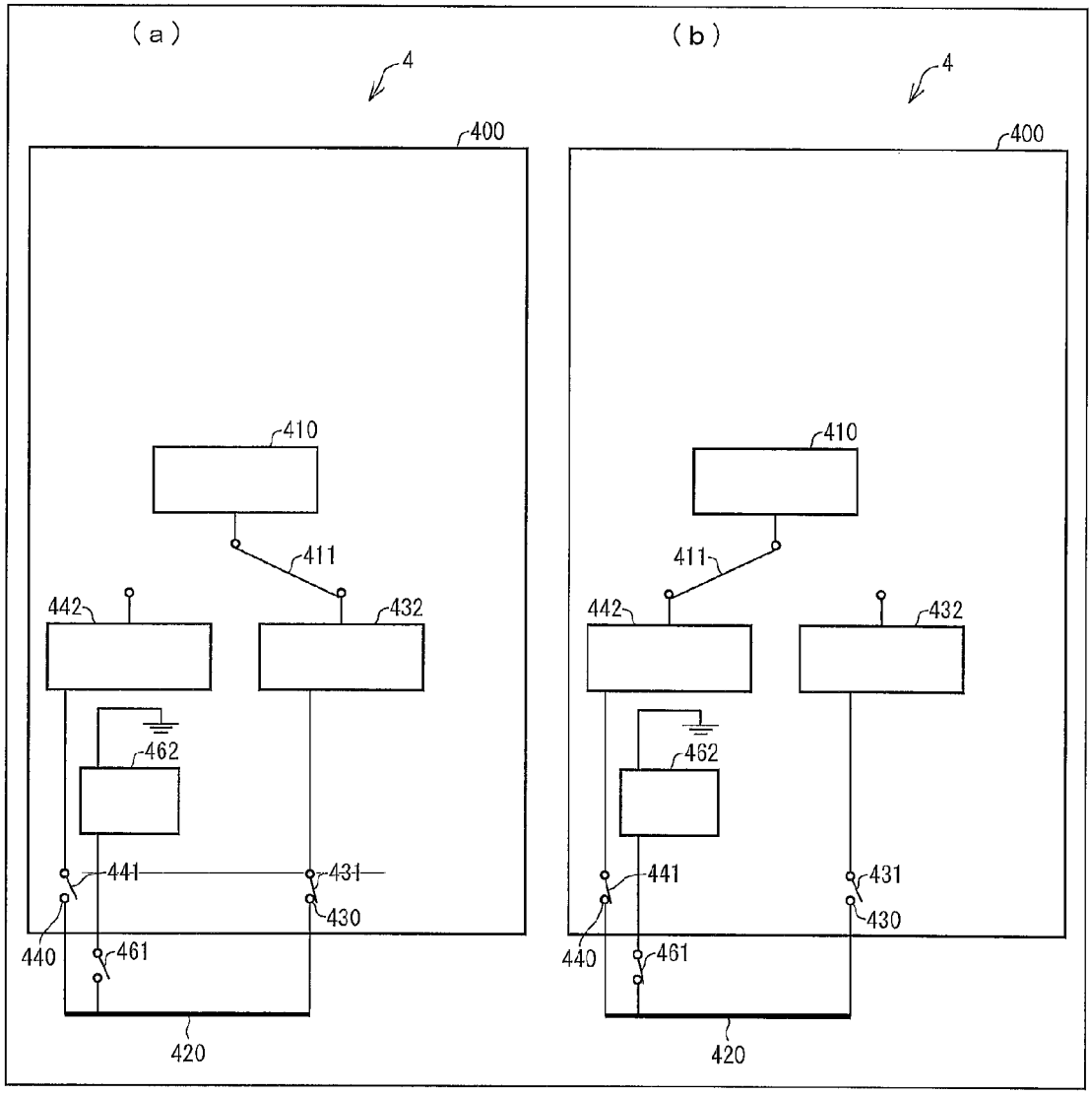
FIG. 6 is a view schematically illustrating a configuration of an antenna device in accordance with an embodiment (Embodiment 4) of the present invention. (*a*) of FIG. 6 illustrates a state where a feeding portion feeds an antenna element. (*b*) of FIG. 6 illustrates a state where the other feeding portion feeds the antenna element.

FIG. 6 is a view schematically illustrating a configuration of an antenna device 4 in accordance with an embodiment (Embodiment 4) of the present invention. (*a*) of FIG. 6 illustrates a state where a feeding portion feeds an antenna element. (*b*) of FIG. 6 illustrates a state where the other feeding portion feeds the antenna element.

The antenna device 4 includes a substrate 400 and an antenna element 420 (see FIG. 6), like the antenna device 2 of Embodiment 2. On the substrate 400 provided are a transmitting and receiving circuit 410, a first switching section (switching section) 411, a first feeding portion 430, a second switching section (switching section, second switching element) 431, a first matching circuit 432, a second feeding portion 440, a third switching section (switching section, second switching element) 441, a second matching circuit 442, a fifth switching section (antenna/ground conductor switching section) 461, and a fourth matching circuit (antenna/ground conductor matching circuit) 462. Note, however, that the antenna device 3 does not include a fourth switching section and a third matching circuit, unlike the antenna device 2 of Embodiment 2.

The antenna element 420 of the antenna device 4 operates as an inverted F antenna, only while the second feeding portion 440 feeds the antenna element 420. The antenna device 4 may thus be configured such that the antenna element operates as the inverted F antenna, only while any one of the feeding portions feeds the antenna element.

(Embodiment 5)

Figure 7:
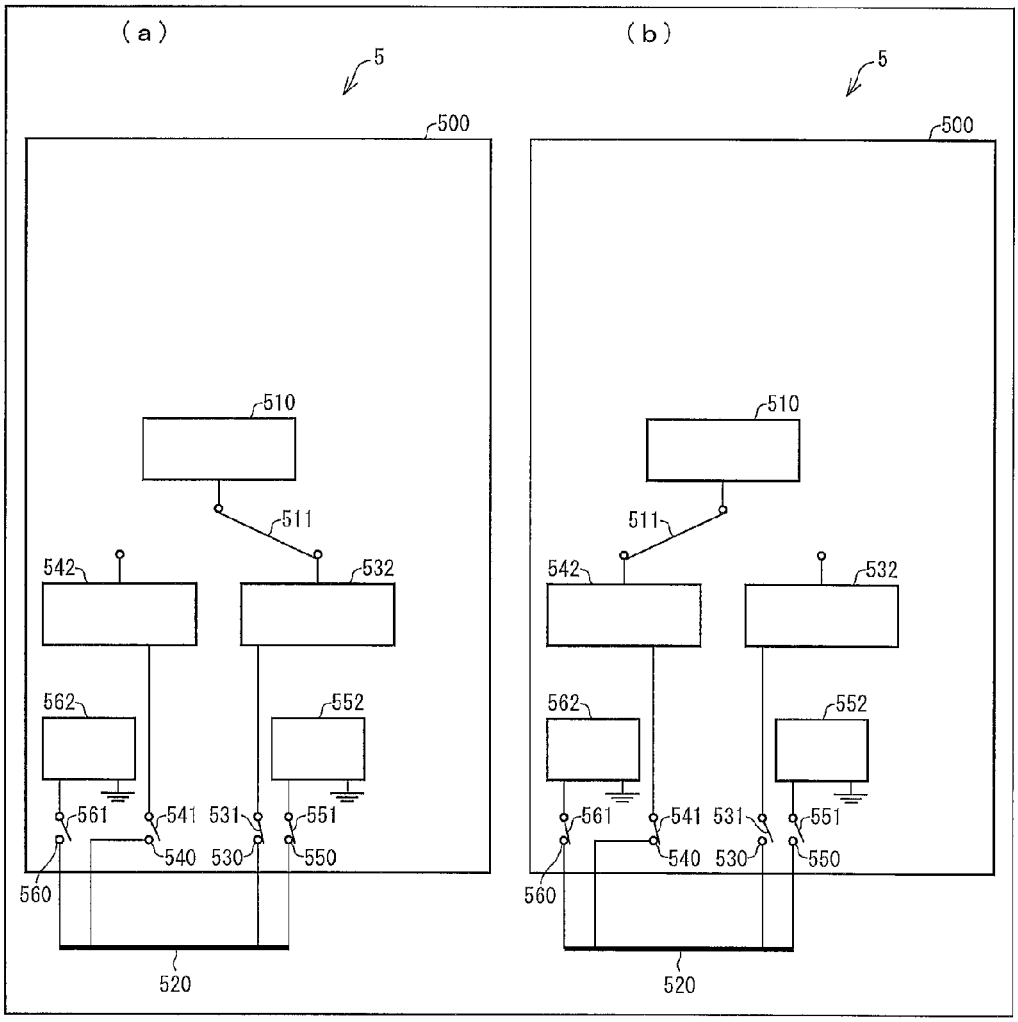
FIG. 7 is a view schematically illustrating a configuration of an antenna device in accordance with an embodiment (Embodiment 5) of the present invention. (*a*) of FIG. 7 illustrates a state where a feeding portion feeds an antenna element. (*b*) of FIG. 7 illustrates a state where the other feeding portion feeds the antenna element.
Figure 8:
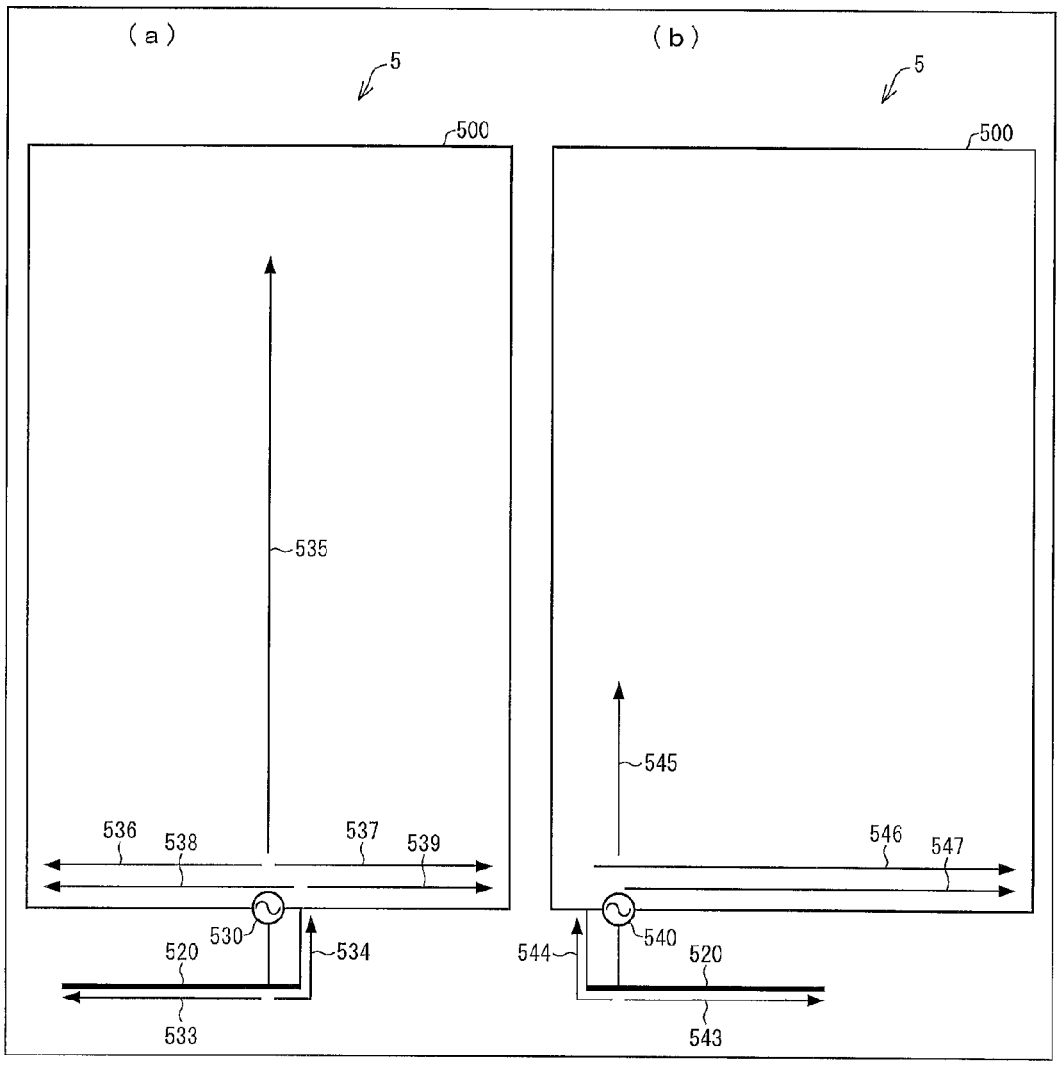
FIG. 8 is a view schematically illustrating high frequency electric current that flows in the antenna device in accordance with the embodiment (Embodiment 5) of the present invention. (*a*) of FIG. 8 illustrates a state where the feeding portion feeds an antenna element. (*b*) of FIG. 8 illustrates a state where the other feeding portion feeds the antenna element.

FIG. 7 is a view schematically illustrating a configuration of an antenna device 5 in accordance with an embodiment (Embodiment 5) of the present invention. FIG. 8 is a view schematically illustrating high frequency electric current that flows in the antenna device 5. Each (*a*) of FIGS. 7 and 8 illustrates a state where a feeding portion feeds an antenna element. Each (*b*) of FIGS. 7 and 8 illustrates a state where the other feeding portion feeds the antenna element.

The antenna device 5 includes a substrate 500 and an antenna element 520 (see FIG. 7), like the antenna device 2 of Embodiment 2. On the substrate 500 provided are a transmitting and receiving circuit 510, a first switching section (switching section) 511, a first feeding portion 530, a second switching section (switching section, first switching element) 531, a first matching circuit 532, a second feeding portion 540, a third switching section (switching section, second switching element) 541, a second matching circuit 542, a third matching circuit (antenna/ground conductor matching circuit) 552, a fourth switching section (antenna/ground conductor switching section) 551, a fourth matching circuit (antenna/ground conductor matching circuit) 562, and a fifth switching section (antenna/ground conductor switching section) 561.

Unlike the antenna device 2 of Embodiment 2, the antenna element 520 has (i) end parts that are connected respectively to the fourth switching section 551 and the fifth switching section 561 and (ii) parts that are connected respectively to the first feeding portion 530 and the second feeding portion 540. The following description will discuss in detail what is different from Embodiment 2, and description of what is identical to Embodiment 2 is omitted in Embodiment 5.

(*a*) of FIG. 7 illustrates a configuration in which the first feeding portion 530 feeds the antenna element 520. As illustrate in (*a*) of FIG. 7, (i) the first switching section 511 connects the transmitting and receiving circuit 510 to the first matching circuit 532, (ii) the second switching section 531 connects the first matching circuit 532 to the first feeding portion 530, (iii) the third switching section 541 disconnects the second matching circuit 542 from the second feeding portion 540, (iv) the fourth switching section 551 electrically connects the third matching circuit 552 to the antenna element 520, and (v) the fifth switching section 561 electrically disconnects the fourth matching circuit 562 from the antenna element 520.

(*a*) of FIG. 8 illustrates a direction in which high frequency electric current flows while the first feeding portion 530 feeds the antenna element 520. While the first feeding portion 530 feeds the antenna element 520, high frequency electric current 533 flows in the antenna element 520 (see (*a*) of FIG. 8). While the high frequency electric current 533 flows in the antenna element 520, high frequency electric current 534 flows, via the fourth switching section 551 and the third matching circuit 552, in a ground conductor provided on the substrate 500. The antenna element 520 operates as a modified inverted F antenna while the first feeding portion 530 feeds the antenna element 520.

Further, high frequency electric current excited by the first feeding portion 530 flows in the ground conductor provided on the substrate 500. The first feeding portion 530 is located in an end part, in a second direction, of the substrate 500. This causes high frequency electric current 535 to flow toward the other end part, in the second direction, of the substrate 500. The first feeding portion 530 is also located in a center part, in a first direction, of the substrate 500. This causes high frequency electric current 536 and high frequency electric current 537 to flow toward respective end parts, in the first direction, of the substrate 500. Further, high frequency electric current that has flown from the antenna element 520 via the fourth switching section 551 to the substrate 500 becomes high frequency electric current 538 and high frequency electric current 539 that flow toward the respective end parts, in the first direction, of the substrate 500.

Note here that the high frequency electric current 536 and the high frequency electric current 537 are reverse phased to each other, and the high frequency electric current 538 and the high frequency electric current 239 are reverse phased to each other. Therefore, they cancel each other to be remarkably weakened. It follows that high frequency electric current flows mainly in the second direction while the first feeding portion 530 feeds the antenna element 520.

(*b*) of FIG. 7 illustrates a configuration in which the second feeding portion 540 feeds the antenna element 520. As illustrated in (*b*) of FIG. 7, (i) the first switching section 511 connects the transmitting and receiving circuit 510 to the second matching circuit 542, (ii) the second switching section 531 disconnects the first matching circuit 532 from the first feeding portion 530, (iii) the third switching section 541 connects the second matching circuit 542 to the second feeding portion 540, (iv) the fourth switching section 551 electrically disconnects the third matching circuit 552 from the antenna element 520, and (v) the fifth switching section 561 electrically connects the fourth matching circuit 562 to the antenna element 520.

(*b*) of FIG. 8 illustrates a direction in which high frequency electric current flows while the second feeding portion 540 feeds the antenna element 520. While the second feeding portion 540 feeds the antenna element 520, high frequency electric current 543 flows in the antenna element 520 (see (*b*) of FIG. 8). While the high frequency electric current 543 flows in the antenna element 520, high frequency electric current 544 flows, via the fifth switching section 561 and the fourth matching circuit 562, in the ground conductor provided on the substrate 500. The antenna element 520 operates as a modified inverted F antenna while the second feeding portion 540 feeds the antenna element 520.

The second feeding portion 540 is located in the end part, in the second direction, of the substrate 500. This causes high frequency electric current 545 to flow toward the other end part, in the second direction, of the substrate 500. The second feeding portion 540 is also located in the end part, in the first direction, of the substrate 500. This causes high frequency electric current 546 to flow toward the other end part, in the first direction, of the substrate 500. Further, high frequency electric current that has flown from the antenna element 520 via the fifth switching section 561 to the substrate 500 becomes high frequency electric current 547 that flows toward the other end part, in the first direction, of the substrate 500.

Note here that the sum of an electric length of the antenna element 520 and the first electric length is closer to a half wavelength of an applied frequency band of the antenna element 520 than the sum of the electric length of the antenna element 520 and the second electric length. This causes the high frequency electric current 546 to be higher than the high frequency electric current 545. Further, the high frequency electric current 547 flows in the first direction. This causes high frequency electric current to flow mainly in the first direction while the second feeding portion 540 feeds the antenna element 520.

Thus, the direction in which high frequency electric current mainly flows in the ground conductor is different from while the first feeding portion 530 feeds the antenna element 520 to while the second feeding portion 540 feeds the antenna element 520. That is, it is possible to switch the direction in which high frequency electric current mainly flows, and to switch the direction of main polarization of a radio wave to be transmitted or received, by switching which one of the first feeding portion 530 and the second feeding portion 540 feeds the antenna element 520. The antenna element 520 can be configured to operate as the modified inverted F antenna. It is therefore possible to improve an antenna property, as with a case where the antenna element 520 is configured to operate as the inverted F antenna. For example, it is possible to prevent deterioration in the antenna property of the antenna device 5 whose housing is being held by hand.

(Embodiment 6)

Figure 9:
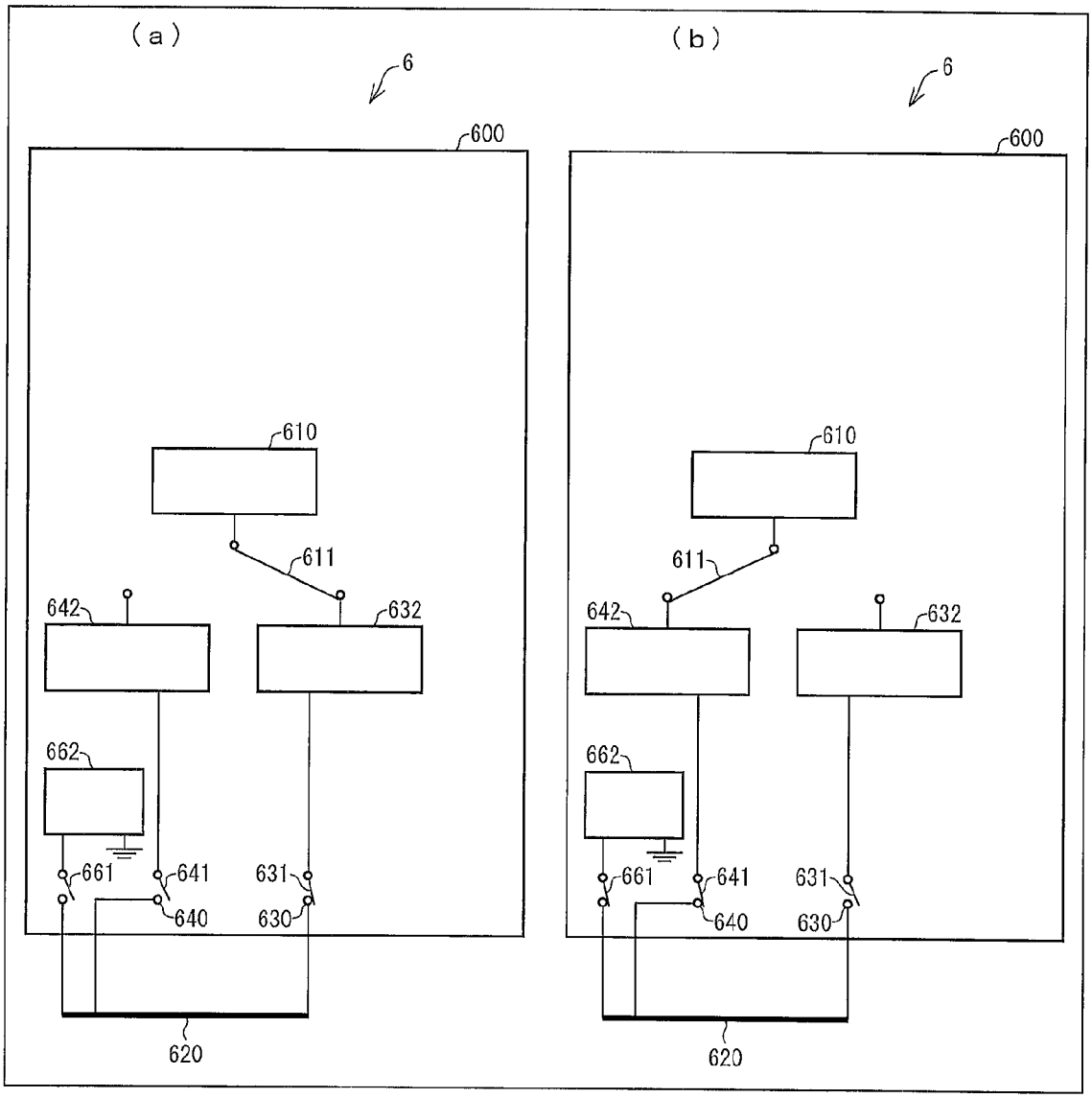
FIG. 9 is a view schematically illustrating a configuration of an antenna device in accordance with an embodiment (Embodiment 6) of the present invention. (*a*) of FIG. 9 illustrates a state where a feeding portion feeds an antenna element. (*b*) of FIG. 9 illustrates a state where the other feeding portion feeds the antenna element.

FIG. 9 is a view schematically illustrating a configuration of an antenna device 6 in accordance with an embodiment (Embodiment 6) of the present invention. (*a*) of FIG. 9 illustrates a state where a feeding portion feeds an antenna element. (*b*) of FIG. 9 illustrates a state where the other feeding portion feeds the antenna element.

The antenna device 6 includes a substrate 600 and an antenna element 620 (see FIG. 9), like the antenna device 5 of Embodiment 5. On the substrate 600 provided are a transmitting and receiving circuit 610, a first switching section (switching section) 611, a first feeding portion 630, a second switching section (switching section, first switching element) 631, a first matching circuit 632, a second feeding portion 640, a third switching section (switching section, second switching element) 641, a second matching circuit 642, a fourth switching section (antenna/ground conductor switching section) 651, and a third matching circuit (antenna/ground conductor matching circuit) 652. Note, however, that the antenna device 6 does not include a fifth switching section and a fourth matching circuit, unlike the antenna device 5 of Embodiment 5.

The antenna element 620 of the antenna device 6 operates as a modified inverted F antenna only while the first feeding portion 630 feeds the antenna element 620. The antenna device 6 may thus be configured such that the antenna element operates as the modified inverted F antenna only while any one of the feeding portions feeds the antenna element.

(Embodiment 7)

Figure 10:
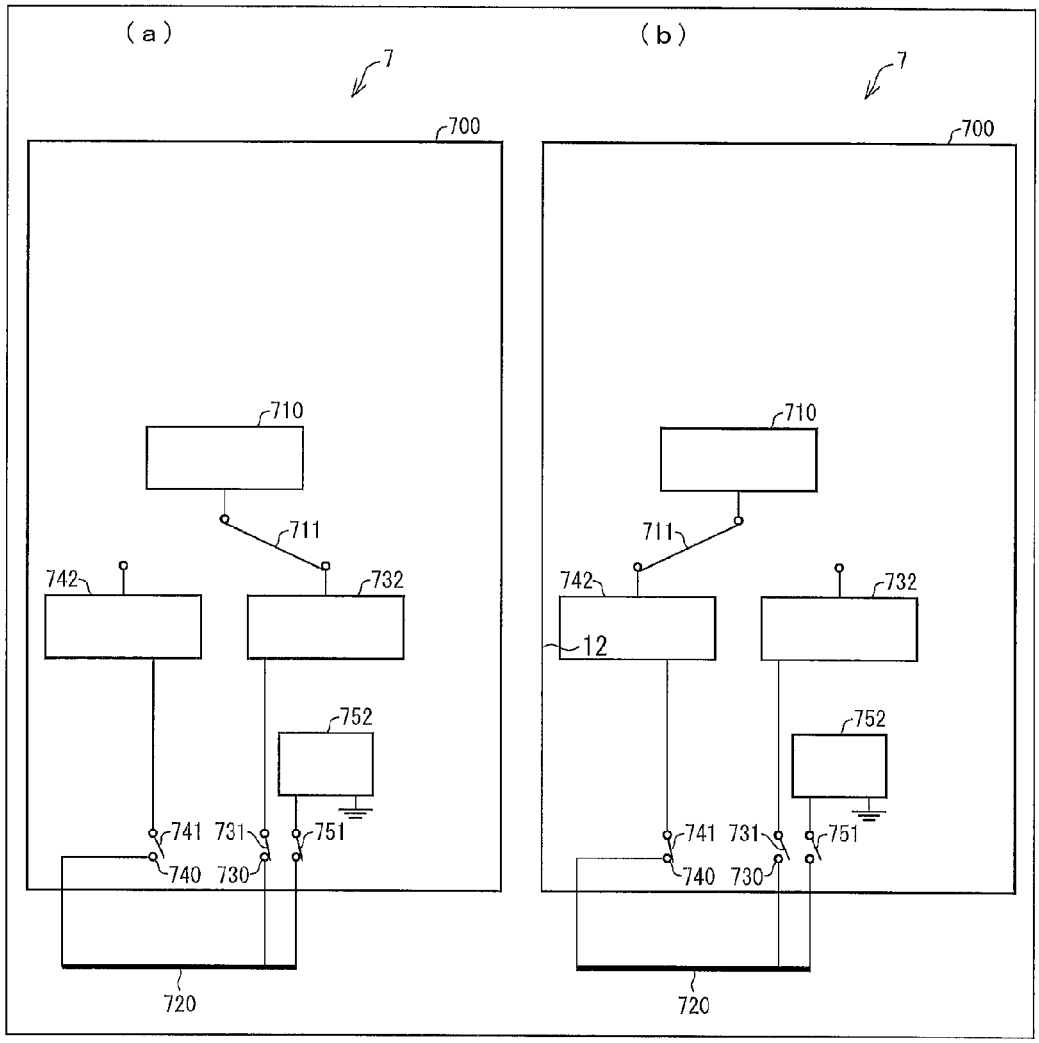
FIG. 10 is a view schematically illustrating a configuration of an antenna device in accordance with an embodiment (Embodiment 7) of the present invention. (*a*) of FIG. 10 illustrates a state where a feeding portion feeds an antenna element. (*b*) of FIG. 10 illustrates a state where the other feeding portion feeds the antenna element.

FIG. 10 is a view schematically illustrating a configuration of an antenna device 7 in accordance with an embodiment (Embodiment 7) of the present invention. (*a*) of FIG. 7 illustrates a state where a feeding portion feeds an antenna element. (*b*) of FIG. 10 illustrates a state where the other feeding portion feeds the antenna element.

The antenna device 7 includes a substrate 700 and an antenna element 720 (see FIG. 10), like the antenna device 5 of Embodiment 5. On the substrate 700 provided are a transmitting and receiving circuit 710, a first switching section (switching section) 711, a first feeding portion 730, a second switching section (switching section, first switching element) 731, a first matching circuit 732, a second feeding portion 740, a third switching section (switching section, second switching element) 741, a second matching circuit 742, a fifth switching section (antenna/ground conductor switching section) 761, and a fourth matching circuit (antenna/ground conductor matching circuit) 762. Note, however, that the antenna device 7 does not include a fourth switching section and a third matching circuit, unlike the antenna device 5 of Embodiment 5.

The antenna element 720 of the antenna device 7 operates as a modified inverted F antenna only while the second feeding portion 740 feeds the antenna element 720. The antenna device 7 may thus be configured such that the antenna element operates as the modified inverted F antenna only while any one of the feeding portions feeds the antenna element.

Alternatively, the antenna device 7 may be configured such that the antenna element operates as an inverted F antenna while any one of the feeding portions feeds the antenna element, and in contrast, the antenna element operates as the modified inverted F antenna while the other of the feeding portions feeds the antenna element.

(Embodiment 8)

Figure 11:
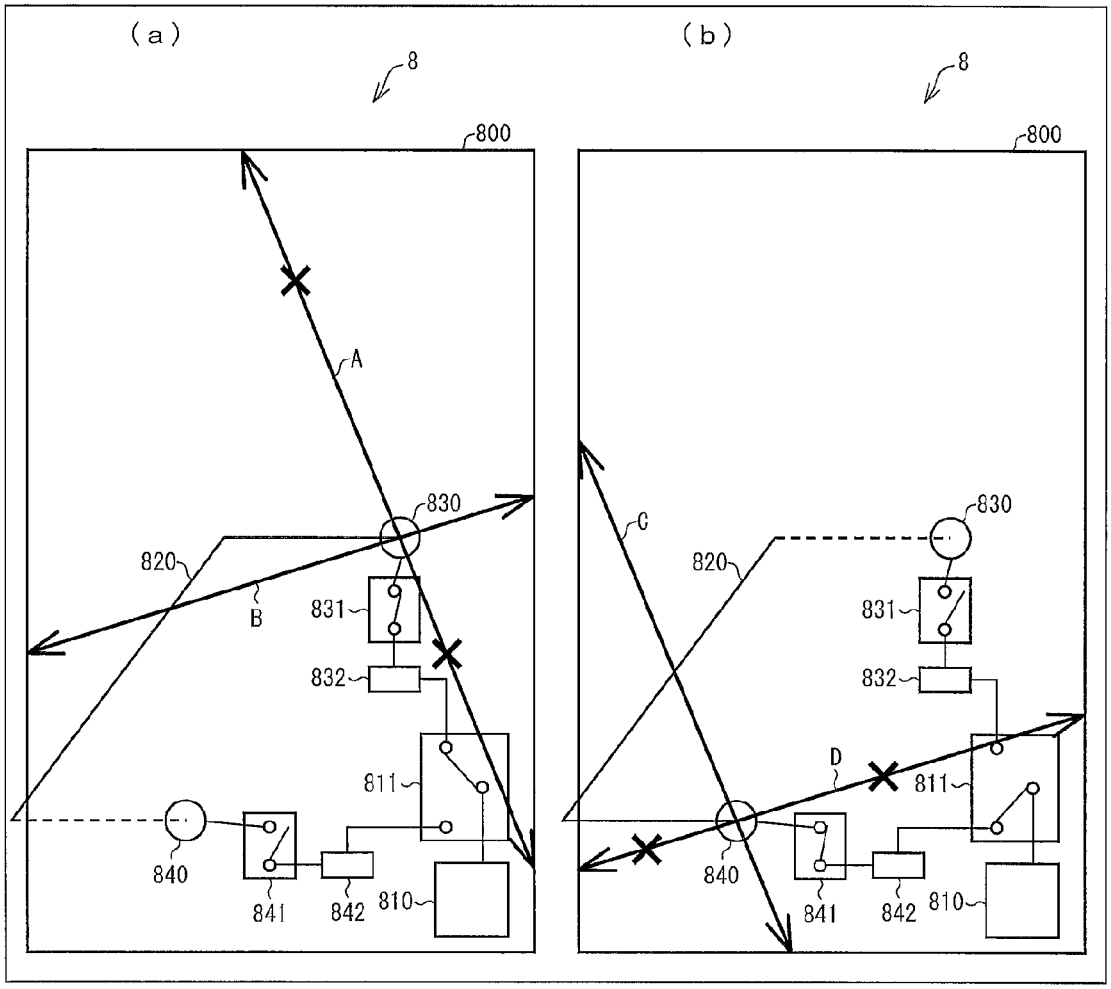
FIG. 11 is a view schematically illustrating a configuration of an antenna device in accordance with an embodiment (Embodiment 8) of the present invention. (*a*) of FIG. 11 illustrates a state where a feeding portion feeds an antenna element. (*b*) of FIG. 11 illustrates a state where the other feeding portion feeds the antenna element.

FIG. 11 is a view schematically illustrating a configuration of an antenna device 8 in accordance with an embodiment (Embodiment 8) of the present invention.

The antenna device 8 includes (i) a substrate 800 on which a ground (ground conductor) is provided and (ii) an antenna element 820 (see FIG. 11). On the substrate 800 provided are a transmitting and receiving circuit 810, a first switching section (switching section) 811, a first feeding portion 830, a second switching section (switching section, first switching element) 831, a first matching circuit 832, a second feeding portion 840, a third switching section (switching section, second switching element) 841, and a second matching circuit 842.

The antenna element 820 has a linear shape. The first feeding portion 830 and the second feeding portion 840 are connected to respective end parts of the antenna element 820. The components of the antenna device 8 are identical to those of the antenna device 1 of Embodiment 1 except for where the components are provided in the antenna device 8, and therefore descriptions of the components are omitted in Embodiment 8. (*a*) of FIG. 11 illustrates a state where the first feeding portion 830 feeds the antenna element 820. (*b*) of FIG. 11 illustrates a state where the second feeding portion 840 feeds the antenna element 820.

Note here that (i) a direction in which high frequency electric current flows in the ground conductor and (ii) where the first feeding portion 830 and the second feeding portion 840 are provided, are determined by determining a first direction and a second direction orthogonal to each other on the substrate 800. Note also that in Embodiment 8, the first direction and the second direction are determined so as to be different from a longitudinal direction and a lateral direction of the substrate 800. Specifically, the first direction is determined so as to be parallel to a path A (first path) and a path C (second path), and the second direction is determined so as to be parallel to a path B (third path) and a path D (fourth path) (see FIG. 11).

The path A passes through the first feeding portion 830, and crosses, in the first direction, the ground conductor provided on the substrate 800. The path B passes through the first feeding portion 830, and crosses, in the second direction, the ground conductor provided on the substrate 800. The path C passes through the second feeding portion 840, and crosses, in the first direction, the ground conductor provided on the substrate 800. The path D passes through the second feeding portion 840, and crosses, in the second direction, the ground conductor provided on the substrate 800.

In Embodiment 8, the first feeding portion 830 and the second feeding portion 840 are provided as below. The configuration in which the first feeding portion 830 and the second feeding portion 840 are provided allows to have main polarization (i) in the second direction while the first feeding portion 830 feeds the antenna element 820 and (ii) in the first direction while the second feeding portion 840 feeds the antenna element 820.

Figure 12:
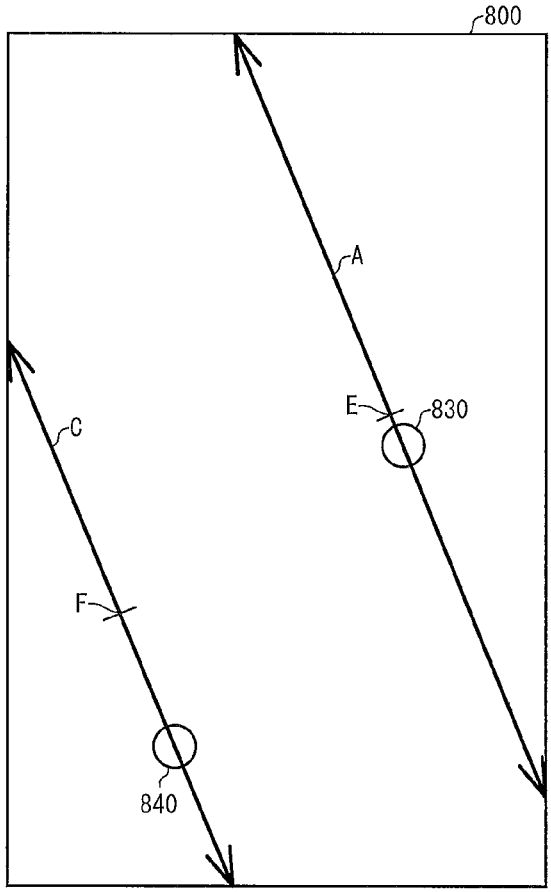
FIG. 12 is a view partially illustrating the configuration of the antenna device in accordance with the embodiment (Embodiment 8) of the present invention.
Figure 13:
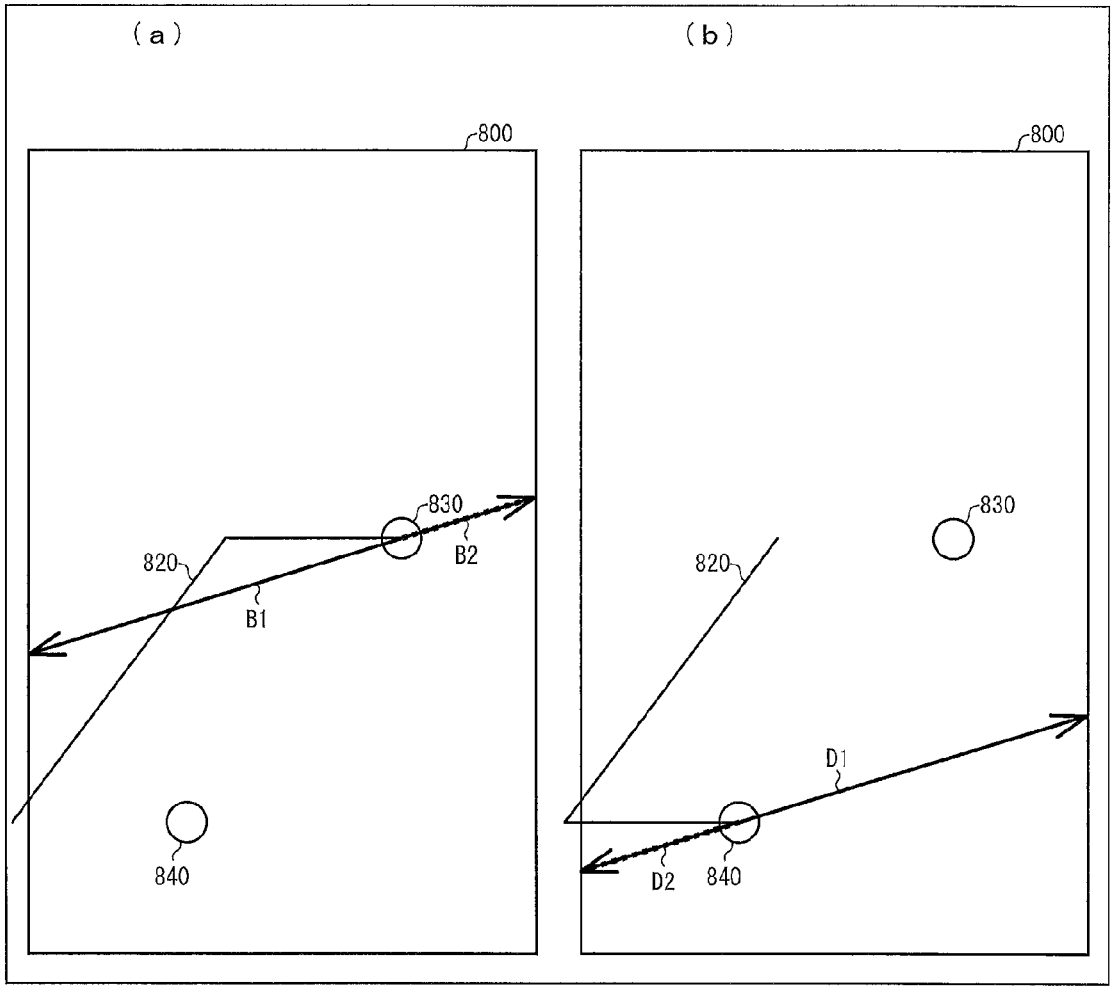
FIG. 13 is a view partially illustrating the configuration of the antenna device in accordance with the embodiment (Embodiment 8) of the present invention. (*a*) of FIG. 13 illustrates a state where the feeding portion feeds the antenna element. (*b*) of FIG. 13 illustrates a state where the other feeding portion feeds the antenna element.
Figure 14:
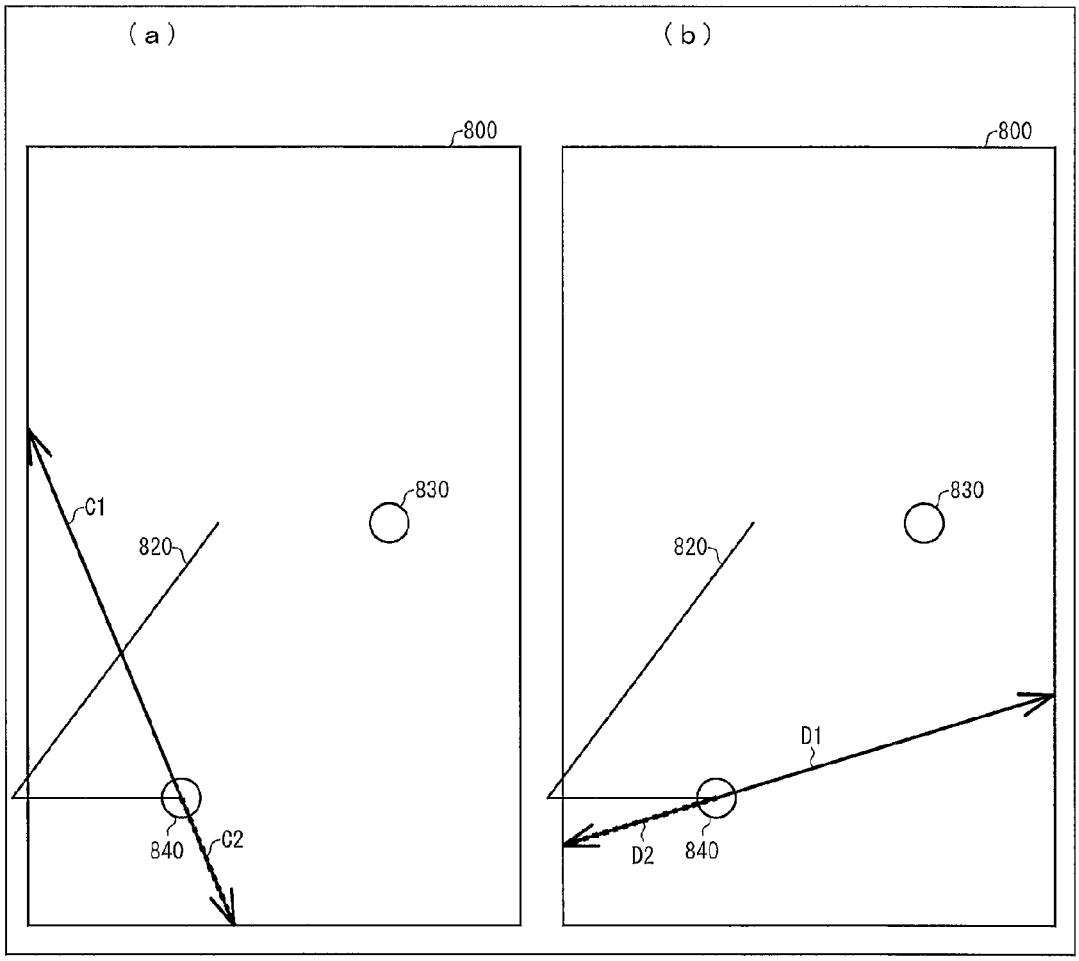
FIG. 14 is a view partially illustrating the configuration of the antenna device in accordance with the embodiment (Embodiment 8) of the present invention. (*a*) of FIG. 14 illustrates a state where the feeding portion feeds the antenna element. (*b*) of FIG. 14 illustrates a state where the other feeding portion feeds the antenna element.

FIGS. 12 through 14 each partially illustrate the configuration of the antenna device 8. Each (*a*) of FIGS. 13 and 14 illustrates a state where the first feeding portion 830 feeds the antenna element 820. Each (*b*) of FIGS. 13 and 14 illustrates a state where the second feeding portion 840 feeds the antenna element 820.

According to Embodiment 8, the first feeding portion 830 and the second feeding portion 840 are positioned such that an electric length between the first feeding portion 830 and a center E of an electric length of the path A is shorter than an electric length between the second feeding portion 840 and a center F of an electric length of the path C (see FIG. 12). Note that a center of an electric length of a path is located distant equally from both ends of the path.

Electric currents, which flow toward respective end parts of a path from a feeding portion provided in the vicinity of a center of an electric length of the path, are reverse phased to each other, and therefore cancel each other. Such a configuration in which the first feeding portion 830 and the second feeding portion 840 are provided as above causes electric currents to further cancel each other in the first direction while the feeding portion 830 feeds the antenna element 820 than while the second feeding portion 840 feeds the antenna element 820. That is, the electric currents being reverse phased to each other further cancel each other in the first direction while the first feeding portion 830 feeds the antenna element 820. This allows to have the main polarization in the second direction. Meanwhile, the electric currents being reverse phased to each other do not cancel each other much (or do not cancel each other) in the first direction while the second feeding portion 840 feeds the antenna element 820. This allows to successfully have the main polarization in the first direction.

Further, according to Embodiment 8, the sum of an electric length of the antenna element 820 and an effective electric length, in the second direction, of the ground conductor is closer to a half wavelength of an applied frequency band of the antenna element 820 while the first feeding portion 830 feeds the antenna element 820 than while the second feeding portion 840 feeds the antenna element 820. Note here that the antenna element 820 and the ground conductor constitute a dipole antenna. This causes higher electric current to flow in a direction in which an electric length of the dipole antenna is closer to the half wavelength of the applied frequency band. That is, according to Embodiment 8, higher electric current flows in the second direction while the first feeding portion 830 feeds the antenna element 820 than while the second feeding portion 840 feeds the antenna element 820. This allows to successfully have the main polarization in the second direction while the first feeding portion 830 feeds the antenna element 820. This also allows to successfully have the main polarization in a direction other than the second direction while the second feeding portion 840 feeds the antenna element 820.

What is meant by the "effective electric length, in the second direction, of the ground conductor while the first feeding portion 830 feeds the antenna element 820" is an electric length obtained by taking into consideration mutual cancellation of electric currents having respective reverse phases, specifically, (an absolute value of) a difference between electric lengths, via the first feeding portion 830, of the path B, that is, a difference in electric length between a path B1 and a path B2 (see (*a*) of FIG. 13). Similarly, what is meant by the "effective electric length, in the second direction, of the ground conductor while the second feeding portion 840 feeds the antenna element 820" is (an absolute value of) a difference between electric lengths, via the second feeding portion 840, of the path D, specifically, a difference in electric length between a path D1 and a path D2 (see (*b*) of FIG. 13). Therefore, the first feeding portion 830 and the second feeding portion 840 are positioned such that the paths B1, B2, D1 and D2 meet the above-described conditions.

Further, according to Embodiment 8, the sum of the electric length of the antenna element 820 and an effective electric length, in the first direction, of the ground conductor is closer to the half wavelength of the applied frequency band than the sum of the electric length of the antenna element 820 and the effective electric length, in the second direction, of the ground conductor, while the second feeding portion 840 feeds the antenna element 820. This causes higher electric current to flow in the first direction than in the second direction, while the second feeding portion 840 feeds the antenna element 820. It is therefore possible to successfully have the main polarization in the first direction while the second feeding portion 840 feeds the antenna element 820.

Note that what is meant by the "effective electric length, in the first direction, of the ground conductor while the second feeding portion 840 feeds the antenna element 820" is (an absolute value of) a difference between electric lengths, via the second feeding portion 840, of the path C, specifically, a difference in electric length between a path C1 and a path C2 (see (*a*) of FIG. 14). Therefore, the second feeding portion 840 is provided such that the paths C1, C2, D1 and D2 meet the above-described conditions.

According to Embodiment 8, it is thus possible to suitably switch the main polarization.

Note that the antenna element 820 of Embodiment 8 can be configured to operate as an inverted F antenna or a modified inverted F antenna, as with those of Embodiments 2 through 7. That is, the antenna device 8 can further include one or two antenna/ground conductor matching circuit(s) and one or two antenna/ground conductor switching section(s). The antenna/ground conductor matching circuit(s) is a matching circuit for matching impedance of the antenna element 820 with respect to the ground conductor and is configured to connect the ground conductor with the antenna/ground conductor switching section(s). The antenna/ground conductor switching section(s) is also connected to a part of the antenna element 820, which part is inside or outside parts of the antenna element 820, to which parts the first feeding portion 830 and the second feeding portion 840 are connected, respectively.

(Embodiment 9)

Figure 15:
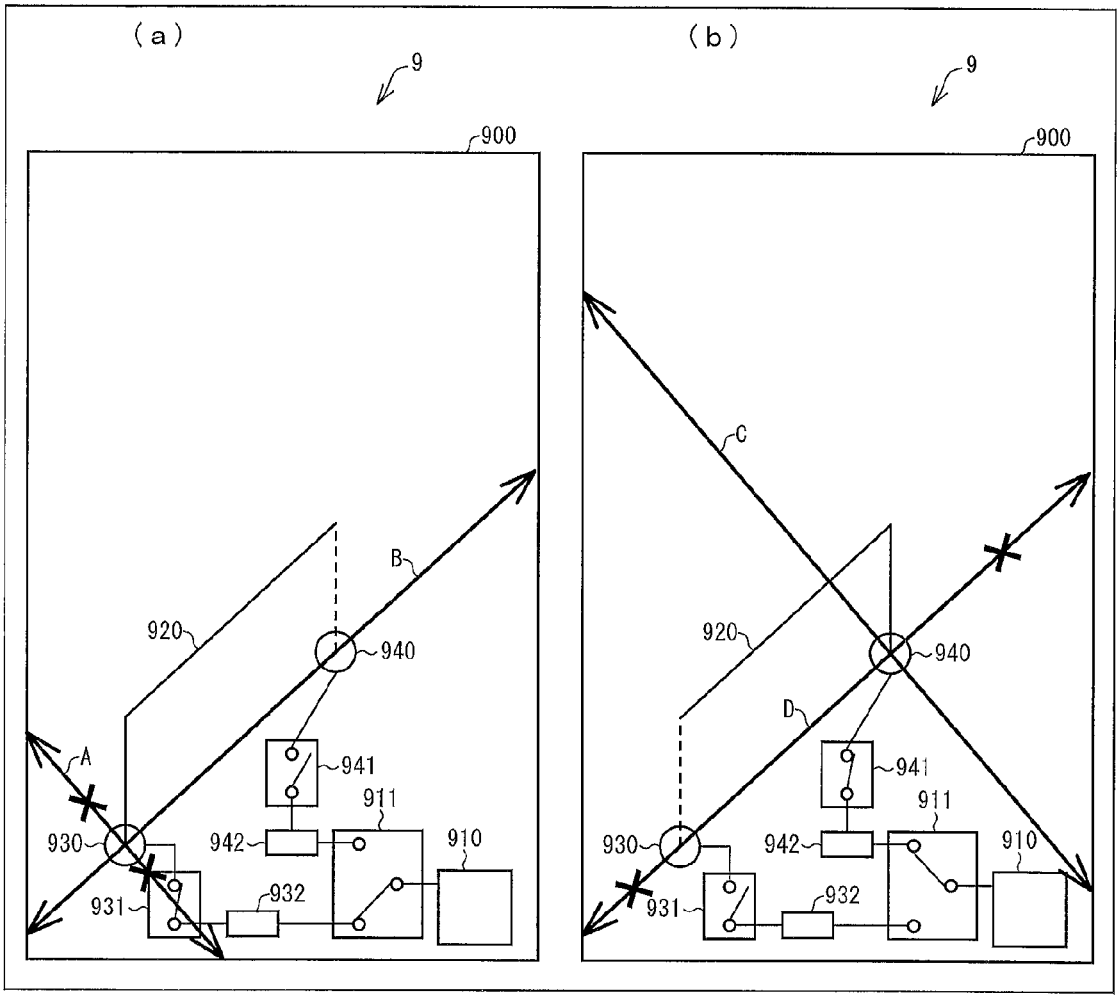
FIG. 15 is a view schematically illustrating a configuration of an antenna device in accordance with an embodiment (Embodiment 9) of the present invention. (*a*) of FIG. 15 illustrates a state where a feeding portion feeds an antenna element. (*b*) of FIG. 15 illustrates a state where the other feeding portion feeds the antenna element.
Figure 16:
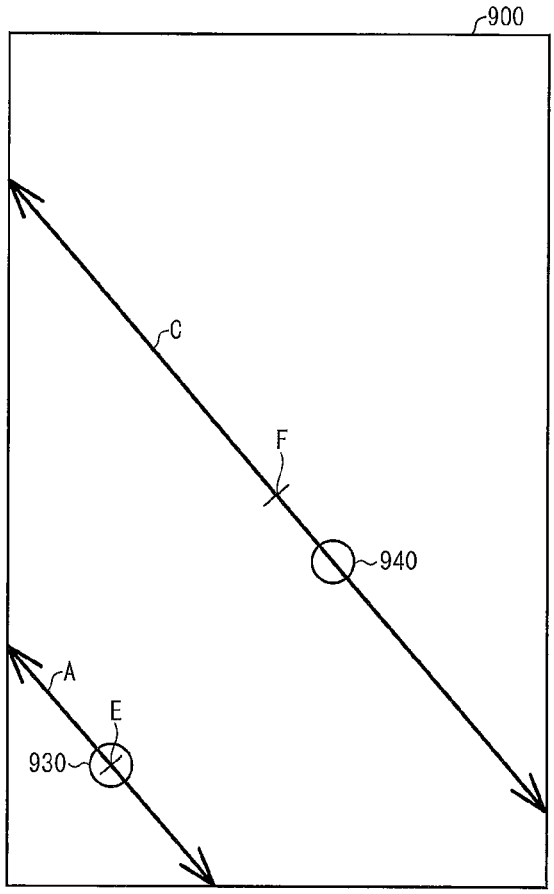
FIG. 16 is a view partially illustrating the configuration of the antenna device in accordance with the embodiment (Embodiment 9) of the present invention.
Figure 17:
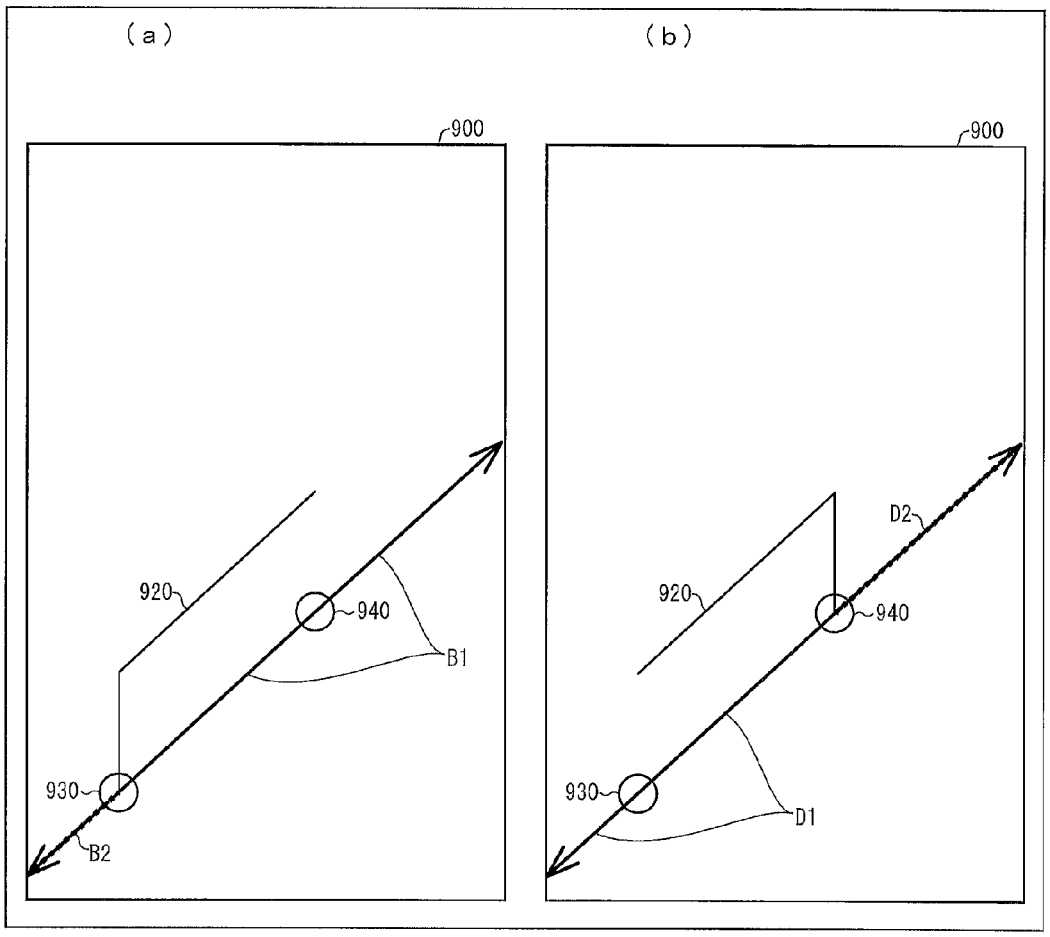
FIG. 17 is a view partially illustrating the configuration of the antenna device in accordance with the embodiment (Embodiment 9) of the present invention. (*a*) of FIG. 17 illustrates a state where the feeding portion feeds the antenna element. (*b*) of FIG. 17 illustrates a state where the other feeding portion feeds the antenna element.
Figure 18:
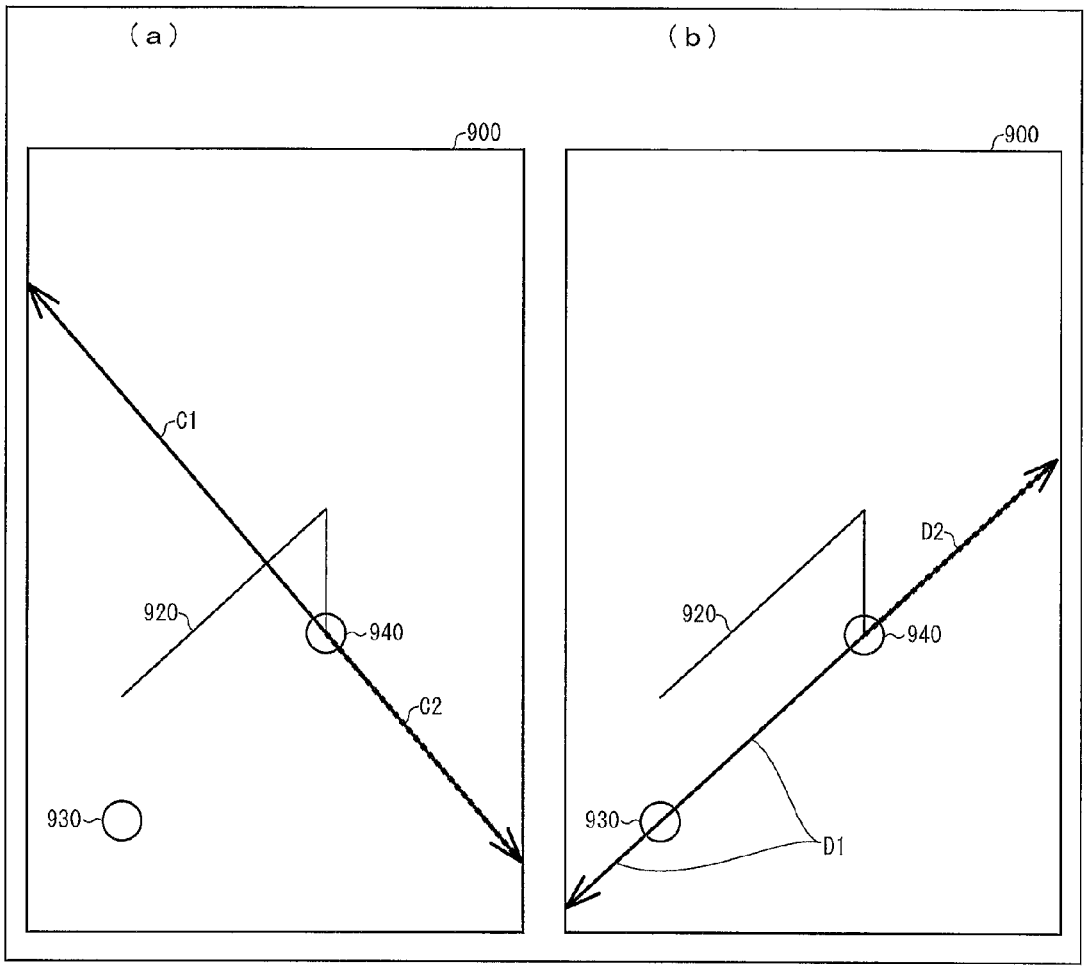
FIG. 18 is a view partially illustrating the configuration of the antenna device in accordance with the embodiment (Embodiment 9) of the present invention. (*a*) of FIG. 18 illustrates a state where the feeding portion feeds the antenna element. (*b*) of FIG. 18 illustrates a state where the other feeding portion feeds the antenna element.

FIG. 15 is a view schematically illustrating a configuration of an antenna device 9 in accordance with an embodiment (Embodiment 9) of the present invention. FIGS. 16 through 18 each are a view partially illustrating the configuration of the antenna device 9.

The antenna device 9 includes (i) a substrate 900 on which a ground (ground conductor) is provided and (ii) an antenna element 920 (see FIG. 15). On the substrate 900 provided are a transmitting and receiving circuit 910, a first switching section (switching section) 911, a first feeding portion 930, a second switching section (switching section, first switching element) 931, a first matching circuit 932, a second feeding portion 940, a third switching section (switching section, second switching element) 941, and a second matching circuit 942.

The antenna element 920 has a linear shape. The first feeding portion 930 and the second feeding portion 940 are connected to respective end parts of the antenna element 920. The components of the antenna device 9 are identical to those of the antenna device 1 of Embodiment 1 except for where the components are provided in the antenna device 9, and therefore descriptions of the components of the antenna device 9 are omitted in Embodiment 9. Each (*a*) of FIGS. 15, 17 and 18 illustrates a state where the first feeding portion 930 feeds the antenna element 920. Each (*b*) of FIGS. 15, 17 and 18 illustrates a state where the second feeding portion 940 feeds the antenna element 920.

In order to determine (i) a direction in which high frequency electric current flows in the ground conductor and (ii) where the first feeding portion 930 and the second feeding portion 940 are provided, a first direction and a second direction orthogonal to each other on the substrate 900 are determined. In Embodiment 9, the first direction and the second direction are determined so as to be different from a longitudinal direction and a lateral direction of the substrate 900. Specifically, the first direction is determined so as to be parallel to a path A (first path) and a path C (second path), and the second direction is determined so as to be parallel to a path B (third path) and a path D (fourth path) (see FIG. 15).

The path A passes through the first feeding portion 930, and crosses, in the first direction, the ground conductor provided on the substrate 900. The path B passes through the first feeding portion 930, and crosses, in the second direction, the ground conductor provided on the substrate 900. The path C passes through the second feeding portion 940, and crosses, in the first direction, the ground conductor provided on the substrate 900. The path D passes through the second feeding portion 940, and crosses, in the second direction, the ground conductor provided on the substrate 900.

The first feeding portion 930 and the second feeding portion 940 of Embodiment 9 are provided under a condition identical to a condition under which the first feeding portion 830 and the second feeding portion 840 of Embodiment 8 are provided. It is therefore possible to have main polarization (i) in the second direction while the first feeding portion 930 feeds the antenna element 920 and (ii) in the first direction while the second feeding portion 940 feeds the antenna element 920.

That is, the first feeding portion 930 and the second feeding portion 940 are positioned such that an electric length between the first feeding portion 930 and a center E of an electric length of the path A is shorter than an electric length between the second feeding portion 940 and a center F of an electric length of the path C (see FIG. 16).

Further, the sum of an electric length of the antenna element 920 and an effective electric length, in the second direction, of the ground conductor is closer to a half wavelength of an applied frequency band of the antenna element 920 while the first feeding portion 930 feeds the antenna element 920 than while the second feeding portion 940 feeds the antenna element 920. That is, the first feeding portion 930 and the second feeding portion 940 are positioned such that the sum of the electric length of the antenna element 920 and a difference in electric length between the path B1 and the path B2 (see (*a*) of FIG. 17) is closer to the half wavelength of the applied frequency band than the sum of the electric length of the antenna element 920 and a difference in electric length between the path D1 and the path D2 (see (*b*) of FIG. 17).

Further, the sum of the electric length of the antenna element 920 and an effective electric length, in the first direction, of the ground conductor is closer to the half wavelength of the applied frequency band than the sum of the electric length of the antenna element 920 and the effective electric length, in the second direction, of the ground conductor, while the second feeding portion 940 feeds the antenna element 920. That is, the second feeding portion 940 is provided such that the sum of the electric length of the antenna element 920 and a difference in electric length between the path C1 and the path C2 (see (*a*) of FIG. 18) is closer to the half wavelength of the applied frequency band than the sum of the electric length of the antenna element 920 and the difference in electric length between the path D1 and the path D2 (see (*b*) of FIG. 18).

Effects brought about by Embodiment 9 are identical to those of Embodiment 8. Thus, the main polarization can also be suitably switched in Embodiment 9.

Note that the antenna element 920 of Embodiment 9 can be configured to operate as an inverted F antenna or a modified inverted F antenna, as with those of Embodiments 2 through 8. That is, the antenna device 9 can further include one or two antenna/ground conductor matching circuit(s) and one or two antenna/ground conductor switching section(s). The antenna/ground conductor matching circuit(s) is a matching circuit, which connects the ground conductor with the antenna/ground conductor switching section(s), for matching impedance of the antenna element 920 with respect to the ground conductor. The antenna/ground conductor switching section(s) is also connected to a part of the antenna element 920, which part is inside or outside parts of the antenna element 920, to which parts the first feeding portion 930 and the second feeding portion 940 are connected, respectively.

(Summary)

An antenna device of the present invention is configured to include: an antenna element; a substrate on which a ground conductor is provided; a first feeding portion and a second feeding portion, provided on the substrate, each for feeding the antenna element; and a switching section for switching which one of the first feeding portion and the second feeding portion feeds the antenna element, a direction in which high frequency electric current mainly flows in the ground conductor being different from while the first feeding portion feeds the antenna element to while the second feeding portion feeds the antenna element.

According to the configuration, any one of the first feeding portion and the second feeding portion feeds the antenna element. The switching section switches which one of the first feeding portion and the second feeding portion feeds the antenna element. The first feeding portion and the second feeding portion are provided on the substrate, and the ground conductor is provided on the substrate. This causes high frequency electric current to flow in the ground conductor while the first feeding portion or the second feeding portion feeds the antenna element. The antenna device of the present invention can suitably transmit and receive a radio wave in a polarization direction along the direction in which high frequency electric current mainly flows in the ground conductor. It is therefore possible to switch the direction of main polarization of a radio wave to be transmitted or received, by switching, by the switching section, which one of the first feeding portion and the second feeding portion feeds the antenna element so as to control the direction in which high frequency electric current mainly flows in the ground conductor. That is, it is possible to switch the direction of the main polarization of the radio wave to be transmitted or received by use of the switching section, by causing the direction in which high frequency electric current mainly flows in the ground conductor to differ between when the first feeding portion feeds the antenna element and when the second feeding portion feeds the antenna element, so as to attain polarization diversity. It is further possible to increase flexibility in design of a device which can attain polarization diversity. This is because the shape of the antenna element is not limited to a specific shape.

It is preferable to configure the antenna device such that the direction is a first direction while the second feeding portion feeds the antenna element, the direction is a second direction orthogonal to the first direction while the first feeding portion feeds the antenna element, and the first feeding portion and the second feeding portion are positioned such that an electric length between the first feeding portion and a center of an electric length of a first path which crosses the ground conductor in the first direction through the first feeding portion is shorter than an electric length between the second feeding portion and a center of an electric length of a second path which crosses the ground conductor in the first direction through the second feeding portion.

According to the configuration, the main polarization is in the first direction while the second feeding portion feeds the antenna element, and the main polarization is in the second direction while the first feeding portion feeds the antenna element. It is thus possible to switch the direction of the main polarization of the radio wave to be transmitted or received, so as to suitably attain polarization diversity.

Note here that according to the configuration, the first feeding portion is provided so as to be closer to the center of the electric length of the first path. This causes electric currents reverse phased to each other to flow in the first direction from the first feeding portion toward respective end parts of the first path to cancel each other, while the first feeding portion feeds the antenna element. It is therefore possible to successfully have the main polarization in the second direction.

In contrast, the second feeding portion is provided far from the center of the electric length of the second path. This causes electric currents that flow in the second direction from the second feeding portion to less cancel each other or not to cancel each other while the second feeding portion feeds the antenna element, unlike while the first feeding portion feeds the antenna element. It is therefore possible to successfully have the main polarization in the first direction.

According to the configuration, it is thus possible to suitably switch the direction of the main polarization (specifically, it is possible to have the main polarization in the first direction while the second feeding portion feeds the antenna element, and to have the main polarization in the second direction while the first feeding portion feeds the antenna element).

It is preferable to configure the antenna device such that the first feeding portion and the second feeding portion are positioned such that the sum of an electric length of the antenna element and a difference in electric length between a part of a third path which crosses the ground conductor in the second direction through the first feeding portion and the other part of the third path, the third path being divided into the part and the other part via the first feeding portion, is closer to a half wavelength of an applied frequency band of the antenna element than the sum of the electric length of the antenna element and a difference in electric length between a part of a fourth path which crosses the ground conductor in the second direction through the second feeding portion and the other part of the fourth path, the fourth path being divided into the part and the other part via the second feeding portion.

Note here that while the first feeding portion feeds the antenna element, an effective electric length, in the second direction, of the ground conductor, which effective electric length is obtained by taking into consideration mutual cancellation of electric currents having respective reverse phases, is the difference in electric length between the part and the other part of the third path. Similarly, while the second feeding portion feeds the antenna element, an effective electric length, in the second direction, of the ground conductor, which effective electric length is obtained by taking into consideration mutual cancellation of electric currents having respective reverse phases, is the difference in electric length between the part and the other part of the fourth path.

Therefore, according to the configuration, the sum of the electric length of the antenna element and the effective electric length, in the second direction, of the ground conductor is closer to the half wavelength of the applied frequency band of the antenna element while the first feeding portion feeds the antenna element than while the second feeding portion feeds the antenna element. This causes higher electric current to flow in the second direction while the first feeding portion feeds the antenna element than while the second feeding portion feeds the antenna element. Therefore, polarization becomes stronger in the second direction while the first feeding portion feeds the antenna element than while the second feeding portion feeds the antenna element. It is thus possible to suitably switch the direction of the main polarization (specifically, it is possible to have the main polarization in the first direction while the second feeding portion feeds the antenna element, and to have the main polarization in the second direction while the first feeding portion feeds the antenna element).

It is preferable to configure the antenna device such that the second feeding portion is provided such that the sum of the electric length of the antenna element and a difference in electric length between a part and the other part of the second path which is divided into the part and the other part via the second feeding portion, is closer to the half wavelength of the applied frequency band of the antenna element than the sum of the electric length of the antenna element and the difference in electric length between the part and the other part of the fourth path.

Note here that while the second feeding portion feeds the antenna element, (i) an effective electric length, in the first direction, of the ground conductor, which effective electric length is obtained by taking into consideration mutual cancellation of electric currents having respective reverse phases, is the difference in electric length between the part and the other part of the second path, and (ii) an effective electric length, in the second direction, of the ground conductor, which effective electric length is obtained by taking into consideration mutual cancellation of electric currents having respective reverse phases, is the difference in electric length between the part and the other part of the fourth path.

Therefore, according to the configuration, while the second feeding portion feeds the antenna element, the sum of the electric length of the antenna element and the effective electric length, in the first direction, of the ground conductor is closer to the half wavelength of the applied frequency band of the antenna element than the sum of the electric length of the antenna element and the effective electric length, in the second direction, of the ground conductor. This causes higher electric current to flow in the first direction than in the second direction, thereby causing the main polarization in the first direction while the second feeding portion feeds the antenna element. It is thus possible to suitably switch the direction of the main polarization (specifically, it is possible to have the main polarization in the first direction while the second feeding portion feeds the antenna element, and to have the main polarization in the second direction while the first feeding portion feeds the antenna element).

It is preferable to configure the antenna device such that the substrate has a surface defined by a first direction and a second direction orthogonal to the first direction, the ground conductor has a first electric length in the first direction and a second electric length in the second direction, the sum of the first electric length and an electric length of the antenna element is closer to a half wavelength of an applied frequency band of the antenna element than the sum of the second electric length and the electric length of the antenna element and, the first feeding portion is provided such that while the first feeding portion feeds the antenna element, reverse phase electric current flows in the ground conductor in the first direction, and a dipole antenna, constituted by the antenna element and the ground conductor, has main polarization in the second direction, and the second feeding portion is provided such that while the second feeding portion feeds the antenna element, higher electric current flows in the ground conductor in the first direction than in the second direction, and the dipole antenna has the main polarization in the first direction. It is further preferable to configure the antenna device such that the first feeding portion is provided on a center part, in the first direction, of the substrate, and on an end part, in the second direction, of the substrate; and the second feeding portion is provided on an end part, in the first and second directions, of the substrate.

According to the configuration, the direction in which high frequency electric current mainly flows in the ground conductor is as below while the antenna element is fed. The following description will first discuss the direction in which high frequency electric current mainly flows in the ground conductor while the first feeding portion feeds the antenna element. In a case where the first feeding portion, which is located in the vicinity of the center of an electric length in the first direction of the substrate, feeds the antenna element, electric currents having respective reverse phases flow from the first feeding portion in the first direction to cancel each other, so that high frequency electric current is weakened in the first direction. In contrast, in a case where the first feeding portion, which is located in the vicinity of an end part of the substrate in the second direction, feeds the antenna element, electric currents hardly cancel each other in the second direction, and therefore high frequency electric current is excited toward the other end part of the substrate in the second direction. Thus, reverse phase electric current is generated in the first direction, and in contrast, such reverse phase electric current is prevented in the second direction. This causes high frequency electric current to flow in the ground conductor mainly in the second direction.

In a case where the second feeding portion, which is located in the vicinity of an end part, in the first and second directions, of the substrate, feeds the antenna element, electric currents hardly cancel each other, and high frequency electric current is excited toward the first direction and the second direction. It should be noted that the substrate and the antenna element are cooperate as a dipole antenna. Therefore, in a case where the sum of the first electric length and the electric length of the antenna element is closer to the half wavelength of the applied frequency band of the antenna element than the sum of the second electric length and the electric length of the antenna element, higher high frequency electric current flows in the first direction than in the second direction. Thus, reverse phase electric current is prevented in the first and second directions. This causes higher electric current to flow in the ground conductor in the first direction than in the second direction, thereby causing high frequency electric current to flow in the ground conductor mainly in the first direction.

According to the configuration, it is thus possible to successfully cause that the direction in which high frequency electric current mainly flows in the ground conductor is different between when the first feeding portion feeds the antenna element and when the second feeding portion feeds the antenna element.

It is preferable that the antenna device includes a first matching circuit, connected to the first feeding portion, for matching impedance of the antenna element; and a second matching circuit, connected to the second feeding portion, for matching the impedance of the antenna element.

According to the configuration, the first matching circuit matches the impedance of the antenna element while the first feeding portion feeds the antenna element, and in contrast, the second matching circuit matches the impedance of the antenna element while the second feeding portion feeds the antenna element. As early described, according to the antenna device of the present invention, the electric length of the dipole antenna constituted by the ground conductor and the antenna element appears different between when the first feeding portion feeds the antenna element and when the second feeding portion feeds the antenna element. Therefore, the impedance of the antenna element is different between when the first feeding portion feeds the antenna element and when the second feeding portion feeds the antenna element. It is therefore preferable that different matching circuits be employed so as to match the impedance of the antenna element.

It is preferable to configure the antenna device such that the switching section includes (i) a first switching element, provided between the first feeding portion and the first matching circuit, for electrically connecting and disconnecting the first feeding portion with the first matching circuit, and (ii) a second switching element, provided between the second feeding portion and the second matching circuit, for electrically connecting and disconnecting the second feeding portion with the second matching circuit.

According to the configuration, it is possible to electrically connect a matching circuit with a feeding portion to be used while electrically disconnecting a matching circuit from a feeding portion which is not to be used. This makes it possible to prevent electric current from accidentally flowing from the antenna element to the matching circuit via the feeding portion which is not to be used. It is therefore possible to carry out suitable transmission and reception by use of the antenna element.

The antenna device can be configured to include an antenna/ground conductor switching section, which connects the antenna element to the ground conductor, for electrically connecting and disconnecting the antenna element with the ground conductor.

According to the configuration, it is possible to electrically connect the antenna element to the ground conductor as appropriate. This allows the antenna element to successfully operate as an inverted F antenna or a modified inverted F antenna.

That is, it is possible to cause the antenna element to operate as the inverted F antenna or the modified inverted F antenna by, while one of the first feeding portion and the second feeding portion feeds the antenna element, electrically connecting the antenna element to the ground conductor by use of the antenna/ground conductor switching section provided in the vicinity of a side of the feeding portion. In contrast, the antenna/ground conductor switching section electrically disconnects the antenna element from the ground conductor while the other feeding portion of the first feeding portion and the second feeding portion feeds the antenna element. Thereby, an operation of the antenna element is not prevented while the other feeding portion of the first feeding portion and the second feeding portion feeds the antenna element. The antenna element thus operates as the inverted F antenna or the modified inverted F antenna. This improves an antenna property. Note that the ground conductor can be connected to parts of the antenna element via respective antenna/ground conductor switching sections, which parts are in the vicinity of the respective end parts of the antenna element. This allows the antenna element to operate as the inverted F antenna or the modified inverted F antenna both while the first feeding portion feeds the antenna element and while the second feeding portion feeds the antenna element.

The antenna device can be configured to include an antenna/ground conductor matching circuit, provided between the antenna/ground conductor switching section and the ground conductor, for matching impedance between the antenna element and the ground conductor.

The configuration allows the antenna element to suitably operate as the inverted F antenna or the modified inverted F antenna.

INDUSTRIAL APPLICABILITY

The present invention is applicable to a field of manufacture of radio communication devices such as (i) mobile phone terminals, (ii) mobile radio terminals (for example, PDAs), and (iii) non-mobile radio communication devices.

REFERENCE SIGNS LIST

1, 2, . . . , and 9: antenna device

100, 200, . . . , and 900: substrate

110, 210, . . . , and 910: transmitting and receiving circuit

111, 211, . . . , and 911: first switching section (switching section)

120, 220, . . . , and 920: antenna element

130, 230, . . . , and 930: first feeding portion

131; 231, . . . , and 931: second switching section (switching section, first switching element)

132, 232, . . . , and 932: first matching circuit

140, 240, and 940: second feeding portion

141, 241, and 941: third switching section (switching section, second switching element)

142, 242, . . . , and 942: second matching circuit

251, 351, 551, and 751: fourth switching section (antenna/ground conductor switching section)

252, 352, 552, and 752: third matching circuit (antenna/ground conductor matching circuit)

261, 461, 561, and 661: fifth switching section (antenna/ground conductor switching section)

262, 462, 562, and 662: fourth matching circuit (antenna/ground conductor matching circuit)

133 through 136, 143 through 145, 233 through 239, 243 through 247, 533 through 539, and 543 through 547: high frequency electric current

The invention claimed is:

1. An antenna device comprising:

an antenna element;

a substrate on which a ground conductor is provided;

a first feeding portion and a second feeding portion, provided on the substrate, each for feeding the antenna element; and a switching section for switching which one of the first feeding portion and the second feeding portion feeds the antenna element, a direction in which high frequency electric current mainly flows in the ground conductor being different between when the first feeding portion feeds the antenna element and when the second feeding portion feeds the antenna element, wherein the direction is a first direction while the second feeding portion feeds the antenna element, the direction is a second direction orthogonal to the first direction while the first feeding portion feeds the antenna element, and the first feeding portion and the second feeding portion are positioned such that an electric length between the first feeding portion and a center of an electric length of a first path which crosses the ground conductor in the first direction through the first feeding portion is shorter than an electric length between the second feeding portion and a center of an electric length of a second path which crosses the ground conductor in the first direction through the second feeding portion.

2. The antenna device as set forth in claim 1, wherein:

the first feeding portion and the second feeding portion are positioned such that the sum of an electric length of the antenna element and a difference in electric length between a part of a third path which crosses the ground conductor in the second direction through the first feeding portion and the other part of the third path, the third path being divided into the part and the other part via the first feeding portion, is closer to a half wavelength of an applied frequency band of the antenna element than the sum of the electric length of the antenna element and a difference in electric length between a part of a fourth path which crosses the ground conductor in the second direction through the second feeding portion and the other part of the fourth path, the fourth path being divided into the part and the other part via the second feeding portion.

3. The antenna device as set forth in claim 2, wherein:

the second feeding portion is provided such that the sum of the electric length of the antenna element and a difference in electric length between a part and the other part of the second path which is divided into the part and the other part via the second feeding portion, is closer to the half wavelength of the applied frequency band of the antenna element than the sum of the electric length of the antenna element and the difference in electric length between the part and the other part of the fourth path.

4. The antenna device as set forth in claim 1, wherein:

the first feeding portion is provided on a center part, in the first direction, of the substrate, and on an end part, in the second direction, of the substrate; and the second feeding portion is provided on an end part, in the first and second directions, of the substrate.

5. The antenna device as set forth in claim 1, comprising:

a first matching circuit, connected to the first feeding portion, for matching impedance of the antenna element; and a second matching circuit, connected to the second feeding portion, for matching the impedance of the antenna element.

6. The antenna device as set forth in claim 1, further comprising:

an antenna/ground conductor switching section, which is configured to connect the antenna element to the ground conductor, for electrically connecting and disconnecting the antenna element with the ground conductor.

7. The antenna device as set forth in claim 6, further comprising:

an antenna/ground conductor matching circuit, provided between the antenna/ground conductor switching section and the ground conductor, for matching impedance between the antenna element and the ground conductor.

8. An antenna device comprising:

an antenna element;

a substrate on which a ground conductor is provided;

a first feeding portion and a second feeding portion, provided on the substrate, each for feeding the antenna element; and a switching section for switching which one of the first feeding portion and the second feeding portion feeds the antenna element, a direction in which high frequency electric current mainly flows in the ground conductor being different between when the first feeding portion feeds the antenna element and when the second feeding portion feeds the antenna element, wherein the substrate has a surface defined by a first direction and a second direction orthogonal to the first direction, the ground conductor has a first electric length in the first direction and a second electric length in the second direction, the sum of the first electric length and an electric length of the antenna element is closer to a half wavelength of an applied frequency band of the antenna element than the sum of the second electric length and the electric length of the antenna element, the first feeding portion is positioned such that while the first feeding portion feeds the antenna element, reverse phase electric current flows in the ground conductor in the first direction, and a dipole antenna, constituted by the antenna element and the ground conductor, has main polarization in the second direction, and the second feeding portion is positioned such that while the second feeding portion feeds the antenna element, higher electric current flows in the ground conductor in the first direction than in the second direction, and the dipole antenna has the main polarization in the first direction.

9. An antenna device comprising:

an antenna element;

a substrate on which a ground conductor is provided;

a first feeding portion and a second feeding portion, provided on the substrate, each for feeding the antenna element;

a switching section for switching which one of the first feeding portion and the second feeding portion feeds the antenna element;

a first matching circuit, connected to the first feeding portion, for matching impedance of the antenna element; and a second matching circuit, connected to the second feeding portion, for matching the impedance of the antenna element, a direction in which high frequency electric current mainly flows in the ground conductor being different between when the first feeding portion feeds the antenna element and when the second feeding portion feeds the antenna element, wherein the switching section includes (i) a first switching element, provided between the first feeding portion and the first matching circuit, for electrically connecting and disconnecting the first feeding portion with the first matching circuit, and (ii) a second switching element, provided between the second feeding portion and the second matching circuit, for electrically connecting and disconnecting the second feeding portion with the second matching circuit.

* * * * *